US008599092B2

(12) United States Patent
Washiro

(10) Patent No.: US 8,599,092 B2
(45) Date of Patent: Dec. 3, 2013

(54) ANTENNA, COMMUNICATION DEVICE, ANTENNA MANUFACTURING METHOD

(75) Inventor: Takanori Washiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 534 days.

(21) Appl. No.: 12/328,045

(22) Filed: Dec. 4, 2008

(65) Prior Publication Data

US 2009/0231227 A1 Sep. 17, 2009

(30) Foreign Application Priority Data

Dec. 12, 2007 (JP) ..... P2007-321251

(51) Int. Cl.
*H01Q 7/08* (2006.01)

(52) U.S. Cl.
USPC ..... 343/788; 343/866

(58) Field of Classification Search
USPC ..... 343/702, 788, 866, 895, 873
See application file for complete search history.

(56) References Cited

U.S. PATENT DOCUMENTS

| | | | | |
|---|---|---|---|---|
| 3,049,711 | A * | 8/1962 | Hooper | 343/702 |
| 5,006,861 | A | 4/1991 | Miller et al. | |
| 6,164,241 | A * | 12/2000 | Chen et al. | 118/723 I |
| 6,211,749 | B1 * | 4/2001 | Yuzurihara et al. | 333/17.3 |
| 6,212,400 | B1 * | 4/2001 | Scholz | 455/575.7 |
| 6,531,031 | B1 * | 3/2003 | Becker et al. | 156/345.48 |
| 6,882,242 | B2 * | 4/2005 | Nelson | 333/35 |
| 2003/0114118 | A1 * | 6/2003 | Fukushima et al. | 455/82 |
| 2006/0076897 | A1 * | 4/2006 | Rostoker et al. | 315/111.41 |

FOREIGN PATENT DOCUMENTS

| | | |
|---|---|---|
| JP | 5-183326 | 7/1993 |
| JP | 06 237116 | 8/1994 |
| JP | 9-275360 | 10/1997 |
| JP | 10-178312 | 6/1998 |
| JP | 2002-204114 | 7/2002 |
| WO | WO99/03166 | 1/1999 |

* cited by examiner

*Primary Examiner* — Hoang V Nguyen
*Assistant Examiner* — Kyana R McCain
(74) *Attorney, Agent, or Firm* — Finnegan, Henderson, Farabow, Garrett & Dunner, L.L.P.

(57) ABSTRACT

An antenna includes a coil that is formed such that one end of the coil is short circuited or open to a ground and a current standing wave is generated when a high frequency signal is applied to another end of the coil. The coil generates a magnetic field standing wave having a frequency corresponding to the high frequency signal, and thereby detects or radiates an electromagnetic wave having the frequency.

23 Claims, 50 Drawing Sheets

—— Eθ Max : −15.33(dBi)
Ave : −19.81(dBi)

– – – Eϕ Max : −19.11(dBi)
Ave : −21.24(dBi)

FREQUENCY : 1575MHz

—— Eθ Max : -9.94(dBi)
Ave : -11.84(dBi)

--- Eφ Max : -7.69(dBi)
Ave : -12.31(dBi)

FREQUENCY : 1575MHz

—— Eθ Max : −9.87(dBi)
Ave : −14.63(dBi)

– – – Eφ Max : −13.37(dBi)
Ave : −15.26(dBi)

FREQUENCY : 1575MHz

—— Eθ Max : −7.53(dBi)
Ave : −11.85(dBi)

– – – Eφ Max : −16.64(dBi)
Ave : −21.55(dBi)

FREQUENCY : 1575MHz

—— Eθ Max : -6.91(dBi)
Ave : -9.79(dBi)

--- Eφ Max : -9.79(dBi)
Ave : -14.67(dBi)

FREQUENCY : 1575MHz

—— Eθ Max : -4.87(dBi)
Ave : -11.38(dBi)

--- Eϕ Max : -9.87(dBi)
Ave : -12.74(dBi)

FREQUENCY : 1575MHz

FIG. 17

| | (1) INTERSECTION IN FRONT OF HOME (JUST ADJACENT TO 9-STORY BUILDING) | (2) ON PEDESTRIAN BRIDGE (THERE ARE NO OBSTACLES IN THE VICINITY) | (3) WIDE INTERSECTION WITH A CLEAR VIEW | (4) IN SHOPPING ARCADE | (5) NARROW INTERSECTION (ADJACENT TO 3-STORY SHOP) | (6) UNDER HIGH TENSION LINE (THERE ARE NO HIGH BUILDINGS) |
|---|---|---|---|---|---|---|
| PATCH ANTENNA | SATELLITE CANNOT BE CAPTURED | AT THE SAME TIME AS START-UP OF SOFTWARE | AT THE SAME TIME AS START-UP OF SOFTWARE | SATELLITE CANNOT BE CAPTURED | 0 MINUTES 39 SECONDS | 1 MINUTE 31 SECONDS |
| ANTENNA 200 | 5 MINUTES 32 SECONDS | AT THE SAME TIME AS START-UP OF SOFTWARE | AT THE SAME TIME AS START-UP OF SOFTWARE | SATELLITE CANNOT BE CAPTURED | 0 MINUTES 05 SECONDS | AT THE SAME TIME AS START-UP OF SOFTWARE |

ANTENNA, COMMUNICATION DEVICE, ANTENNA MANUFACTURING METHOD

CROSS REFERENCES TO RELATED APPLICATIONS

The present invention contains subject matter related to Japanese Patent Application JP 2007-321251 filed in the Japan Patent Office on Dec. 12, 2007, the entire contents of which being incorporated herein by reference.

BACKGROUND OF THE INVENTION

1. Field of the Invention

The present invention relates to an antenna, a communication device, and an antenna manufacturing method.

2. Description of the Related Art

In recent years, wireless communication that uses various frequency bands is utilised. In wireless communication, it is important to reduce noise and thereby improve gain. On the other hand, various electronic devices have been developed and are used. A clock of a signal transmitted through electronic devices tends to have a higher frequency. As the frequency becomes higher, various electric noises are generated from inside the electronic devices. These electric noises may interfere with wireless communication. Further, electric noise comes not only from outside a communication device that is performing wireless communication, but also electric noise is generated inside the communication device itself.

SUMMARY OF THE INVENTION

Generally, a noise source in a communication device is located nearer than a transmitting side communication device of a received signal and other noise sources. Therefore, the communication device is likely to be affected by the influence of the noise generated inside the communication device. For example, a signal from an artificial satellite used for a global positioning system (GPS) has a low level, and influence of electric noise cannot be ignored.

When an interfering wave, such as electric noise, is in a frequency band used for communication, if a normal antenna and a filter are used, it is difficult to remove the noise of a received signal caused by an interfering electric wave. In this case, communication signal cannot be successfully received even when good antenna gain is obtained.

Normally, in many cases, evaluation of electric noise generated inside a communication device cannot be performed until the final stage of the development process after assembling the communication device. Until then, the antenna design and the circuit design for other circuits in the communication device are independently and separately carried out. Accordingly, in many cases, at the final stage of the development of the communication device, the antenna and other circuits etc. are assembled together, a field test is performed, and this issue is discovered for the first time. In terms of time schedule, it is difficult to take a countermeasure and improve performance from this stage. Even if a countermeasure is planned, it involves a design change and the like, resulting in an increase in development cost. In light of the above circumstances, even in the case of GPS receivers that have already been released on the market, there is a possibility that the performance is worse due to interference inside the device.

There is a magnetic current antenna that functions as an antenna that is unlikely to be affected by the influence of electric noise. The magnetic current antenna detects a magnetic field in a transmitted electromagnetic wave. It is expected that an electric field is the main cause of the influence of electric noise generated inside the device. Because the magnetic current antenna detects a magnetic field, it is considered that the magnetic current antenna is unlikely to be affected by the influence of electric noise caused by an electric field. Examples of the magnetic current antenna include a very small loop antenna.

However, in a magnetic current antenna, such as a very small loop antenna, the radiation element is very small as compared to the wavelength, and the ratio of radiation resistance to input resistance is low. Accordingly, efficiency in the entire antenna system of the magnetic current antenna is extremely low as compared to other antennas. Thus, although the magnetic current antenna is unlikely to be affected by the influence of electric noise, reception sensitivity of desired signals is reduced due to a reduction in antenna efficiency.

The present invention addresses the issues described above and provides an antenna, a communication device, and an antenna manufacturing method that are new and improved and that make it possible to suppress the influence of electric noise without reducing antenna gain.

According to an embodiment of the present invention that addresses the issues described above, there is provided an antenna that includes a coil that is formed such that one end of the coil is short circuited or open to a ground and a current standing wave is generated when a high frequency signal is applied to another end of the coil. The coil generates a magnetic field standing wave having a frequency corresponding to the high frequency signal, and thereby detects or radiates an electromagnetic wave having the frequency.

With this structure, when the coil is used for a receiving device, a magnetic field of a signal (an electromagnetic wave) transmitted from a transmitter side generates a magnetic field standing wave having the frequency of the magnetic field in the coil. The magnetic field standing wave causes the coil to generate a current standing wave. The current standing wave is output from the other end of the coil. In other words, the coil can detect a magnetic field while increasing gain, in the same manner that a dipole antenna that utilizes electric current detects an electric field while increasing gain. Further, when the coil is used for a transmitting device, the coil can generate a magnetic field in the opposite manner to the above.

The coil may have an effective length that is an integral multiple of a quarter wavelength of the current standing wave.

With this structure, an integral multiple of a quarter wavelength of the standing wave is generated in the coil by electric current of the electromagnetic wave.

A winding wire of the coil may be wound in a turning direction so that directions of a magnetic field generated in the coil when the current standing wave is generated are the same.

With this structure, the directions of the magnetic field generated when the current standing wave is generated in the coil can be aligned. Thus, the magnetic field generated in the coil can be strengthened.

The winding wire of the coil may be wound in a turning direction that is reversed by setting a node in the magnetic field standing wave as a boundary.

With this structure, the directions of the magnetic field in the coil can be aligned.

One end of the coil may be short circuited to the ground, the coil may have an effective length that is a half wavelength of the current standing wave, and the winding wire of the coil may be wound in a turning direction that is reversed by setting a half point of an overall length of the winding wire as a boundary.

With this structure, a half wavelength antenna can be fabricated.

Further, the winding wire of the coil may be wound around a surface of a core having a high permeability or may be embedded in the core.

Furthermore, a length of the winding wire of the coil may be adjusted to a length at which the current standing wave is generated when the high frequency signal is applied.

With this structure, a magnetic field standing wave can be generated in the coil.

According to another embodiment of the present invention that addresses the issues described above, there is provided a communication device that includes a coil that is formed such that one end of the coil is short circuited or open to a ground and a current standing wave is generated when a high frequency signal is applied to another end of the coil. The coil generates a magnetic field standing wave having a frequency corresponding to the high frequency signal, and thereby detects or radiates an electromagnetic wave having the frequency.

With this structure, a magnetic field can be detected while increasing gain.

According to another embodiment of the present invention that addresses the issues described above, there is provided an antenna manufacturing method that includes the steps of: short circuiting or opening one end of a coil serving as a radiation element to a ground; applying a high frequency signal to another end of the coil; and adjusting a length of a winding wire of the coil so that a current standing wave is generated in the coil by the high frequency signal.

With this structure, an antenna can be manufactured that detects a magnetic field while increasing gain.

According to the embodiments of the present invention described above, influence of electric noise can be suppressed without reducing antenna gain.

BRIEF DESCRIPTION OF THE DRAWINGS

FIG. 17 is an explanatory table that shows measurement results of reception performance when the antenna according to the second embodiment is mounted on the GPS receiver device;

DETAILED DESCRIPTION OF THE PREFERRED EMBODIMENTS

Figure 1:
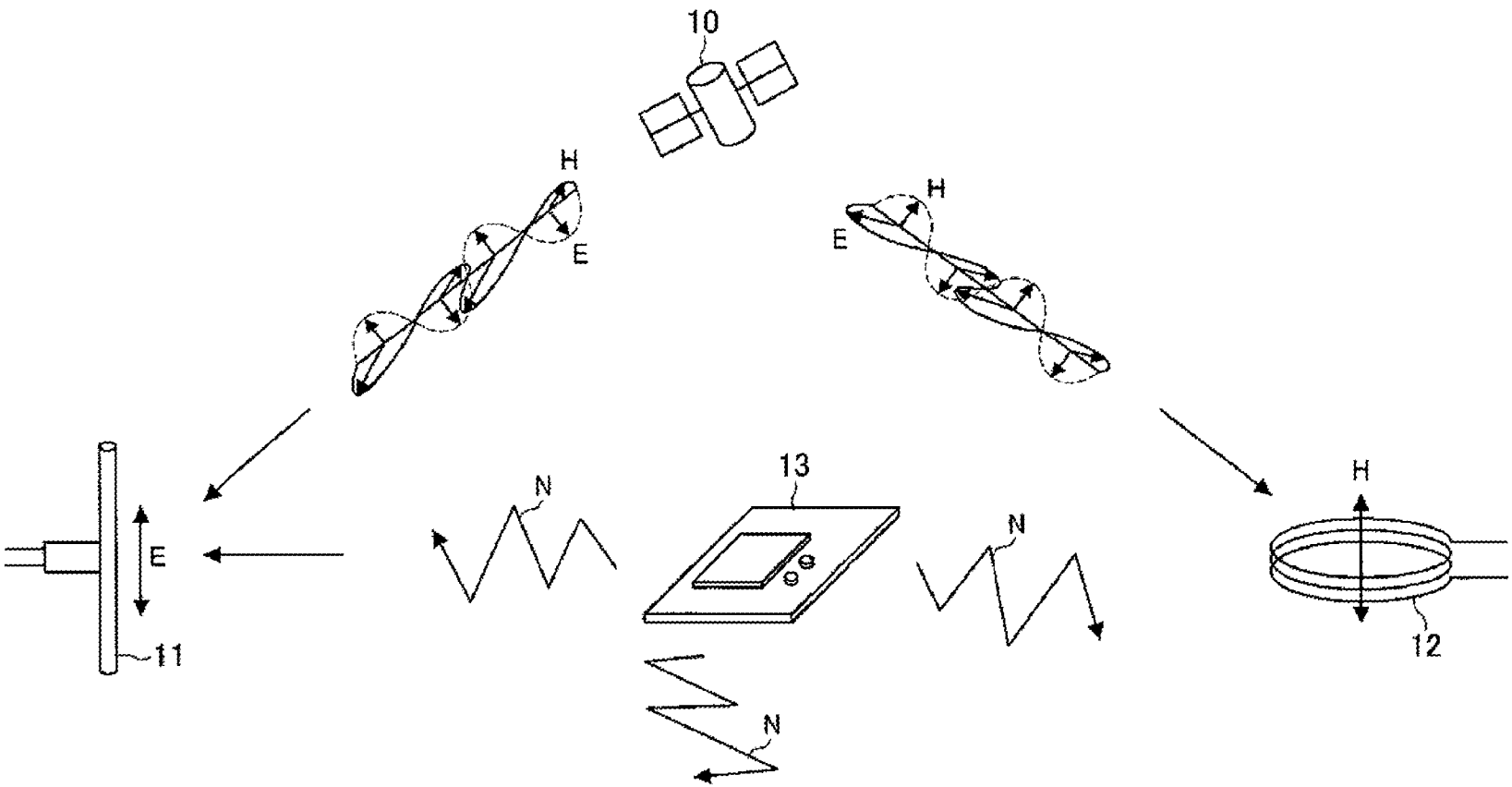
FIG. 1 is an explanatory diagram that illustrates a global positioning system (GPS) that is an application example of an antenna according to each embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First, before explaining an antenna according to each embodiment, features of an antenna according to a related art that need improvement will be explained. Then, consideration on how to improve these features that was obtained as a result of painstaking research conducted by the inventors of the present invention will be explained.

Antenna According to the Related Art

In order to explain the antenna according to the related art, in the below description, a global positioning system (GPS) is taken as an example of a communication system to which the antenna according to each embodiment of the present invention is applied. However, this example is not intended to limit the communication system to which the antenna according to each embodiment of the present invention is applied. The antenna according to each embodiment of the present invention can be applied to various communication systems.

FIG. 1 is an explanatory diagram that illustrates a GPS that is an applied example of the antenna according to each embodiment of the present invention.

As shown in FIG. 1, an artificial satellite 10 transmits a signal (an electromagnetic wave) in the GPS. The electromagnetic wave can be regarded as a wave of an electric field E and a magnetic field H in the far field. Antennas are roughly classified, based on the reception principle, into a current antenna 11 (for example, a dipole antenna) that detects the electric field E and a magnetic current antenna 12 (for example, a very small loop antenna) that detects the magnetic field H.

The current antenna 11 receives the electric field E of an electromagnetic wave, and also receives an electric noise N from an internal circuit 13 of a communication device in which the current antenna 11 itself is incorporated. Meanwhile, the magnetic current antenna 12 receives the magnetic field H of an electromagnetic wave, but is unlikely to receive the electric noise N.

This reason will be explained in more detail. The electric noise N is caused by a current flowing in the internal circuit 13. Therefore, the electric noise N is mainly electric field noise, and includes little magnetic current noise.

If an electromagnetic field generated by the current antenna 11 is approximated as an infinitesimal electric dipole, the electromagnetic field is expressed as the following Expressions 1A to 1C.

Note that, in Expressions 1A to 1C, r denotes a distance from the dipole, θ denotes an angle from the direction of an axis of the dipole, φ denotes a rotation angle about the axis of the dipole, ∈ denotes a dielectric constant, l denotes a length of the dipole, Q denotes the oscillation of an electric charge of the current dipole, ω denotes an angular frequency, and k denotes a wave number.

Further, an electric field $E_r$ denotes an electric field of a longitudinal wave generated from the dipole, an electric field $E_0$ denotes an electric field of a transverse wave generated from the dipole, and a magnetic field $H_\phi$ denotes a magnetic field of a transverse wave generated around the dipole.

Expression 1

$$E_r = \frac{Ql}{2\pi\varepsilon} e^{-jkr}\left(\frac{1}{r^3} + \frac{jk}{r^2}\right)\cos\theta \qquad \text{Expression 1A}$$

$$E_\theta = \frac{Ql}{4\pi\varepsilon} e^{-jkr}\left(\frac{1}{r^3} + \frac{jk}{r^2} - \frac{k^2}{r}\right)\sin\theta \qquad \text{Expression 1B}$$

$$H_\phi = \frac{j\varpi Ql}{4\pi\varepsilon} e^{-jkr}\left(\frac{1}{r^2} - \frac{jk}{r}\right)\sin\theta \qquad \text{Expression 1C}$$

As shown in Expressions 1A to 1C, the electric field $E_r$ and the electric field $E_0$ includes a term that is attenuated by the cube of the distance r, but the magnetic field $H_\phi$ does not include a term that is attenuated by the cube of the distance r. It is conceivable that an electromagnetic field generated by an infinitesimal electric dipole directly indicates the reception sensitivity of an electromagnetic wave of the infinitesimal electric dipole. Thus, from Expressions 1A to 1C, it is found that the reception sensitivity of the current antenna 11 is high with respect to the electric field $E_r$ and the electric field $E_0$ in the near field, but the reception sensitivity of the current antenna 11 is low with respect to the magnetic field $H_\phi$ in the near field.

Likewise, if an electromagnetic field generated by the magnetic current antenna 12 is approximated as an infinitesimal magnetic dipole, this electromagnetic field is expressed as the following Expressions 2A to 2C.

Note that, in Expressions 2A to 2C, r denotes a distance from the dipole, θ denotes an angle from the direction of an axis (a coil axis) of the dipole, ϕ denotes a rotation angle about the axis of the dipole, μ denotes permeability, S denotes a cross sectional area of a coil, I denotes a current flowing in the coil, ω denotes an angular frequency, and k denotes a wave number.

Further, a magnetic field $H_r$ denotes a magnetic field of a longitudinal wave generated from the dipole, a magnetic field $H_0$ denotes a magnetic field of a transverse wave generated from the dipole, and an electric field $E_\phi$ denotes an electric field of a transverse wave generated around the dipole.

Expression 2

$$H_r = \frac{IS}{2\pi} e^{-jkr}\left(\frac{1}{r^3} + \frac{jk}{r^2}\right)\cos\theta \qquad \text{Expression 2A}$$

$$H_\theta = \frac{IS}{4\pi} e^{-jkr}\left(\frac{1}{r^3} + \frac{jk}{r^2} - \frac{k^2}{r}\right)\sin\theta \qquad \text{Expression 2B}$$

$$E_\phi = -\frac{j\omega\mu IS}{4\pi\varepsilon} e^{-jkr}\left(\frac{1}{r^2} - \frac{jk}{r}\right)\sin\theta \qquad \text{Expression 2C}$$

As shown in Expressions 2A to 2C, the magnetic field $H_r$ and the magnetic field $H_\theta$ include a term that is attenuated by the cube of the distance r, but the electric field $E_\phi$ does not include a term that is attenuated by the cube of the distance r. It is conceivable that an electromagnetic field generated by an infinitesimal electric dipole directly indicates the reception sensitivity of an electromagnetic wave of the infinitesimal electric dipole. Thus, from Expressions 2A to 2C, it is found that the reception sensitivity of the magnetic current antenna 12 is high with respect to the magnetic field $H_r$ and the magnetic field $H_0$ in the near field, but the reception sensitivity of the magnetic current antenna 12 is low with respect to the electric field $E_\phi$ in the near field.

As is found from the approximation by the infinitesimal dipole described above, the magnetic current antenna 12 has lower reception sensitivity to an electric field in the near field as compared to the current antenna 11. Accordingly, it can be expected that the magnetic current antenna 12 receives radio waves in the far field, but has lower sensitivity to electric noise (an electric field) in the near field.

However, in a very small loop antenna, which is one example of the magnetic current antenna 12, the radiation element is very small as compared to the wavelength, and the ratio of the radiation resistance to the input resistance is low. As a result, efficiency of the entire antenna system of the very small loop antenna is low.

Given this, if a magnetic current antenna having a half wavelength radiation element can be fabricated in the same manner as is a normal current dipole antenna, while reducing the influence of electric noise by utilizing magnetic current, gain can be increased and efficiency of the entire antenna system can thereby be improved. In the normal current dipole antenna, by utilizing the fact that "electric charge (electron) that produces current" and an "electric conductor through which current flows" exist, the wavelength of the electric field or current is determined, and the radiation element is formed based on the wavelength. However, "magnetic charge that produces magnetic current" corresponding to the "electric charge (electron) that produces current" does not physically exist (at least is not known), and a "magnetic conductor through which magnetic current flows" corresponding to the "electric conductor through which current flows" also does not physically exist. Accordingly, it is unclear which material is to be used for forming the radiation element and how to determine the wavelength.

The present inventors identified the issues of the antenna according to the related art, and conducted painstaking research on an antenna that can obtain the above-described characteristics. As a result, the present inventors have conceived of the antenna according to each embodiment of the present invention. Next, the antenna that has been created as a result of the painstaking research conducted by the present inventors will be explained.

Antenna according to each embodiment of the present invention

First, with reference to FIG. 2A and FIG. 2B, the result of the research conducted by the present inventors about the fact that the "magnetic charge that produces magnetic current" and the "magnetic, conductor through which magnetic current flows" do not exist as described above will be explained.

Figure 2A:
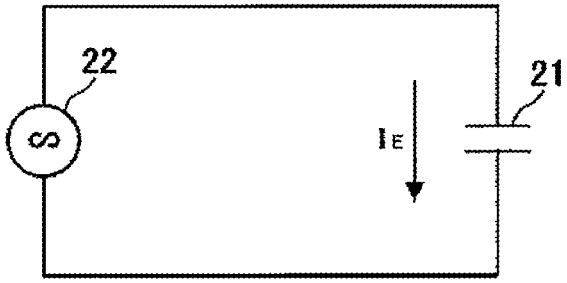
FIG. 2A is an explanatory diagram that illustrates a displacement magnetic current that is used when the antenna according to each embodiment of the present invention is fabricated.
Figure 2B:
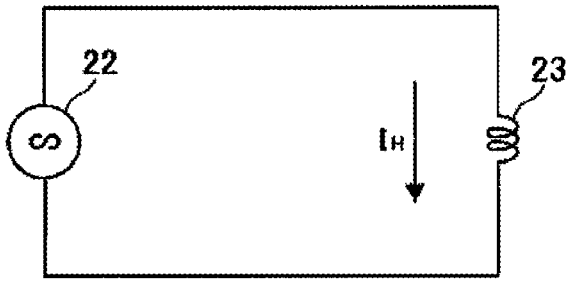
FIG. 2B is an explanatory diagram that illustrates the displacement magnetic current that is used when the antenna according to each embodiment of the present invention is fabricated.

FIG. 2A and FIG. 2B are explanatory diagrams each showing a displacement magnetic current that is used when the antenna according to each embodiment of the present invention is fabricated.

If an alternate voltage is applied from an alternating current power source 22 to a capacitor 21 as shown in FIG. 2A, an alternate current flows. However, an electric charge is not actually given and received between electrodes of the capacitor 21. Accordingly, in order to explain about the alternate current, it can be assumed that a displacement current $I_E$ flows between the electrodes of the capacitor 21. However, an electric charge does not actually move, and the displacement current $I_E$ is defined by the following Expression 3 from an electric field $D_n$ and an area S of the electrode.

Expression 3

$$I_E = \frac{d}{dt}\int_S D_n\, dS \qquad \text{Expression 3}$$

On the other hand, if an alternate voltage is applied from the alternating current power source 22 to a coil 23 as shown in FIG. 2B, it can be assumed that an alternate current flows, a magnetic field is generated in the coil 23, and a magnetic current flows. In order to explain the magnetic current in a similar manner to the above displacement current $I_E$, it is assumed that a displacement magnetic current $I_H$ flows in the coil 23. Then, the displacement magnetic current $I_H$ is defined as the following Expression 4A based on a magnetic field $B_n$. Thus, the displacement magnetic current $I_H$ can be calculated from the following Expression 4B. Note that, in Expression 4B N denotes the number of turns of the coil 23, and R denotes the radius of the coil 23.

Expression 4

$$I_H = \frac{d}{dt}\int_S B_n\,dS \qquad \text{Expression 4A}$$

$$I_H = \frac{d}{dt}\int_S \mu_0 H_n\,dS \cong \frac{d}{dt}\int_S \mu_0 \frac{I\cdot N}{2R}\,dS \cong \frac{\pi\mu_0 IN}{2}\cdot\frac{dI}{dt} \qquad \text{Expression 4B}$$

It is found from Expression C that, if a high-frequency voltage is applied to the coil 23 and a high-frequency current is input, the displacement magnetic current $I_H$ that is proportional to a rate of change of a current I is generated inside the coil 23.

Figure 3A:
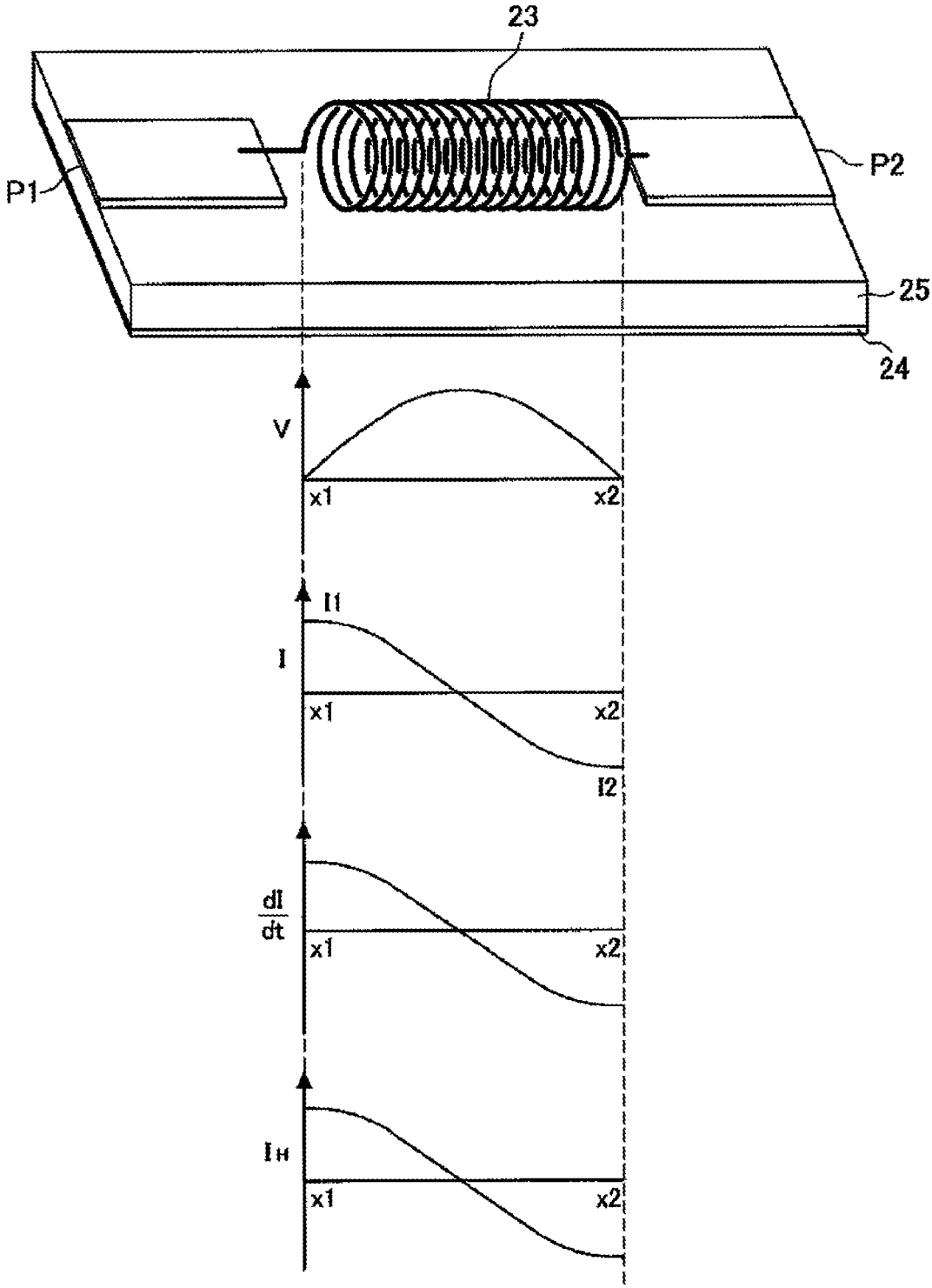
FIG. 3A is an explanatory diagram that illustrates a coil whose characteristics were measured when the antenna according to each embodiment of the present invention was fabricated.
Figure 3B:
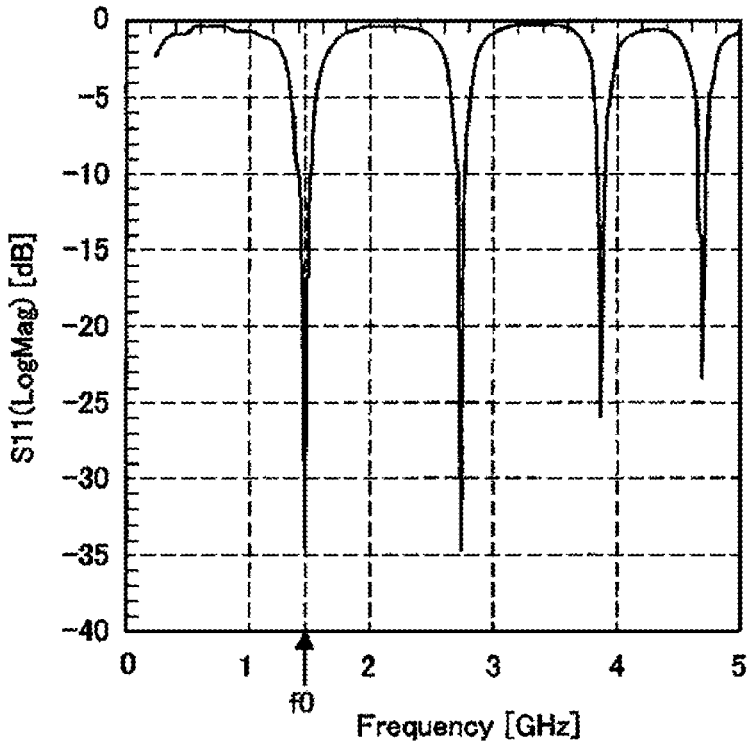
FIG. 3B is a diagram that shows a measurement result of the characteristics of the coil shown in FIG. 3A.
Figure 3C:
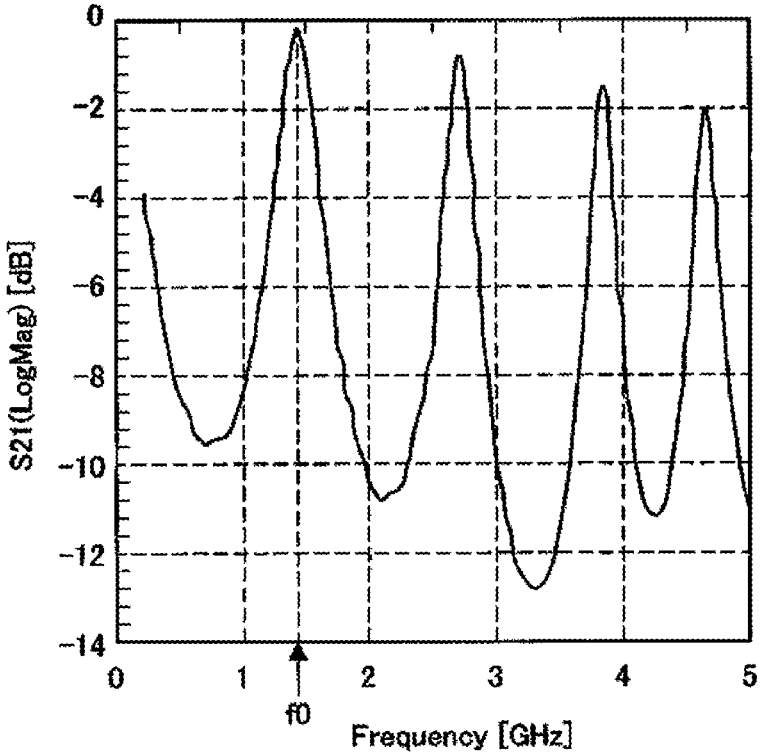
FIG. 3C is a diagram that shows a measurement result of the characteristics of the coil shown in FIG. 3A.
Figure 3D:
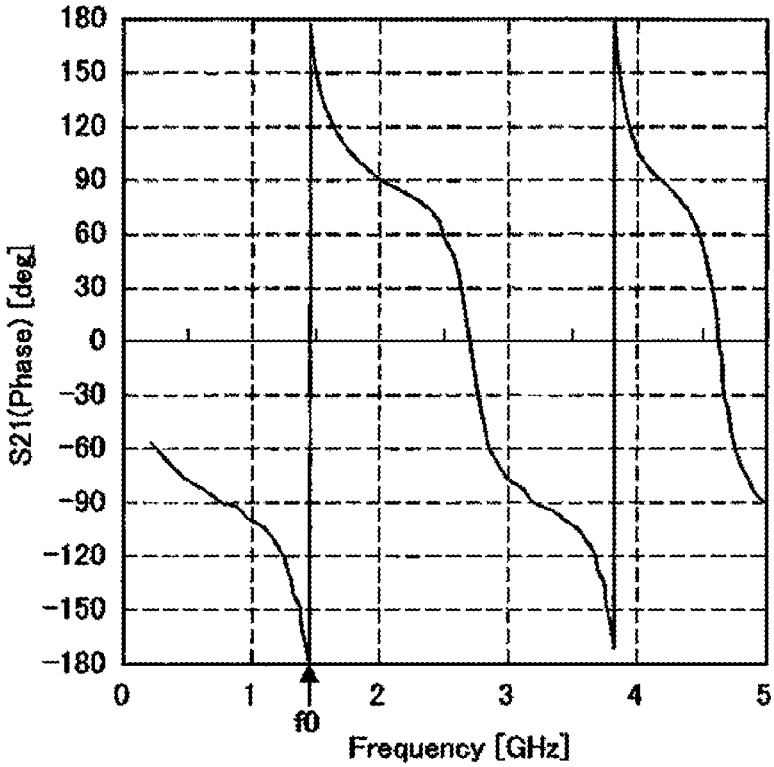
FIG. 3D is a diagram that shows a measurement result of the characteristics of the coil shown in FIG. 3A

Given this, the coil 23 shown in FIG. 3A was prepared, and characteristics of the coil 23 were measured. Measurement results are shown in FIG. 3B to FIG. 3D.

FIG. 3A is an explanatory diagram that illustrates a coil whose characteristics were measured when the antenna according to each embodiment of the present invention was fabricated. FIG. 3B to FIG. 3D are diagrams each showing a measurement result of the characteristics of the coil shown in FIG. 3A.

The coil 23 shown in FIG. 3A was formed such that a coil inner diameter ϕ was set to 1 mm, the number of turns to 36, and the coil length to 5 mm. The coil 23 was placed on an upper surface of a substrate 25 having a bottom surface on which a tabular ground 24 is formed. The thickness of the substrate 25 was set to 0.8 mm. Ports P1 and P2 were formed using micro strip lines, as an input terminal (a feeding point) and an output terminal of the coil 23, respectively. In order to measure the characteristics of the coil 23, S parameters were measured using the ports P1 and P2 as reference planes. Note that, in FIG. 3A, x1 denotes an end of the coil 23 on the port P1 side, and x2 denotes an end of the coil 23 on the port P2 side.

The finite-length coil 23 behaves like a distributed constant circuit not like a lumped circuit, and the phase at the port P1 differs from the phase at the port P2. As shown in FIG. 3B and FIG. 3C, it is found from the measurement results of the S parameters that, at frequency f0, the phase of the coil 23 rotates by a half wavelength (180°) between the port P1 and the port P2.

When the port P2, namely, the coil end x2 is short circuited to the ground, a half wavelength standing wave having a voltage V is generated at the frequency f0, with x1 and x2 being fixed ends. FIG. 3A conceptually shows the voltage V, the current I, the rate of change of the current dI/dt, and the displacement magnetic current $I_H$ that are generated in the coil 23. Note that each waveform shows a waveform at a predetermined time point, and time points of the respective waveforms are not the same (also in the measurement results of the characteristics, which will be described later). Due to this standing wave, the current I also forms a half wavelength standing wave. However, x1 and x2 of the standing wave of the current I are free ends. Further, the phases of the current I1 at x1 and the current I2 at x2 are reversed. The rate of change of the current dI/dt takes the largest value at an anti-node of the standing wave of the current I, and takes the value of 0 at a node of the standing wave. Accordingly, the rate of change of the current dI/dt forms a half wavelength standing wave with x1 and x2 being free ends, like the current I. As described above, the displacement magnetic current $I_H$ is proportional to the rate of change of the current dI/dt. Therefore, it is conceivable that the displacement magnetic current $I_H$ also forms a half wavelength standing wave with x1 and x2 being free ends.

In summary, it can be assumed that the coil 23 that was formed and arranged as described above has an element length corresponding to a half wavelength, with respect to the displacement magnetic current $I_H$ at the frequency f0. This frequency f0 is defined as the resonance frequency with respect to the magnetic current.

Relationship Between the Coil Size and the Resonance Frequency

Figure 4A:
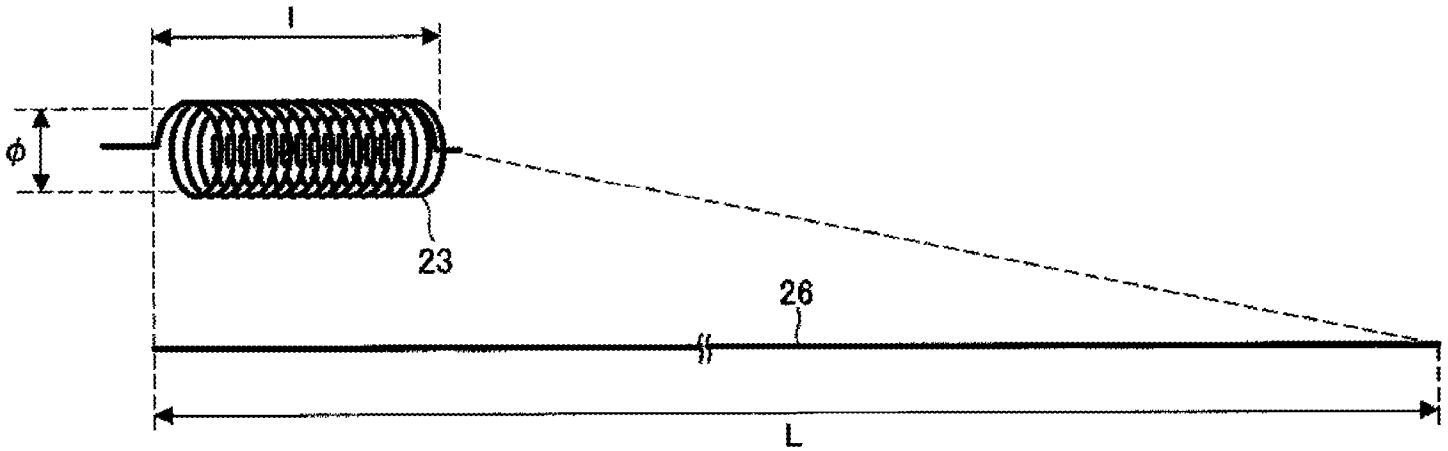
FIG. 4A is an explanatory diagram that illustrates a resonance frequency of the antenna according to each embodiment of the present invention.
Figure 4B:
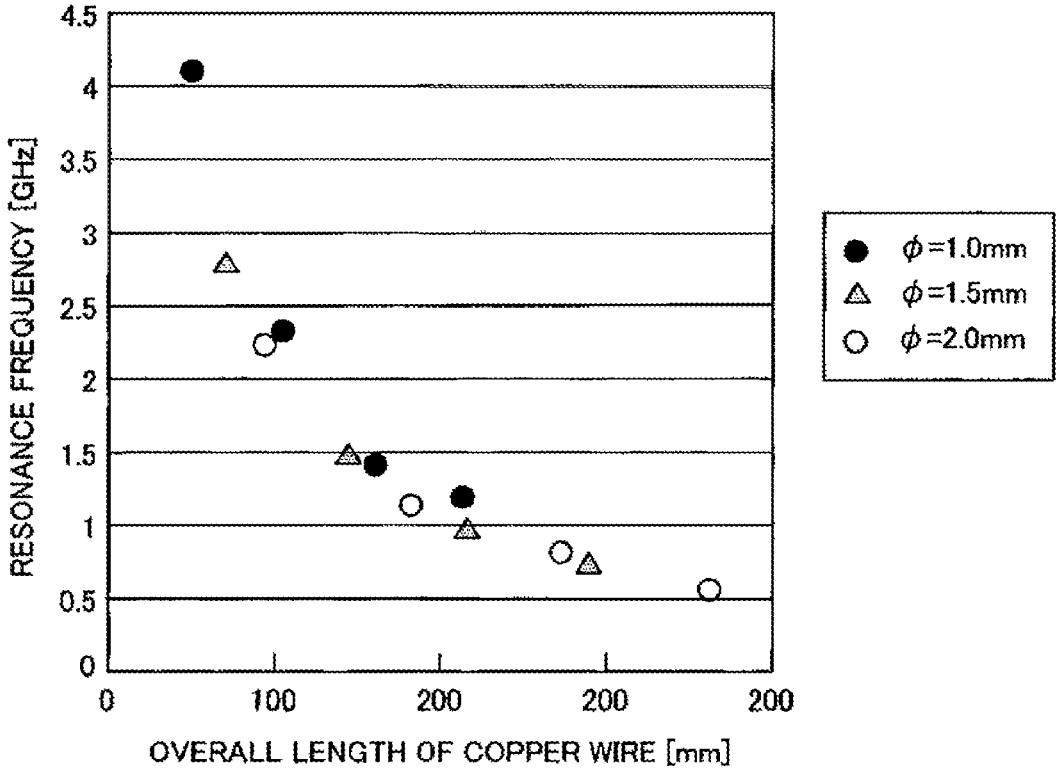
FIG. 4B is an explanatory diagram that illustrates the resonance frequency of the antenna according to each embodiment of the present invention.

The resonance frequency f0 of the magnetic current is defined as described above. The next issue is how to determine the size of the coil 23 in order to adjust the resonance frequency f0 to a desired frequency. FIG. 4A and FIG. 4B show the results of the measurements performed to determine the size of the coil 23.

FIG. 4A and FIG. 4B are explanatory diagrams that illustrate a resonance frequency of the antenna according to each embodiment of the present invention.

It is expected that the resonance frequency f0 depends on, for example, the material and thickness of the winding wire of the coil 23. However, here, what influence the size of the coil 23 has on the resonance frequency f0 was measured. A copper wire of a thickness of 0.3 mm was used as a winding wire 26 of the coil 23. The winding wire 26 was wound around a cylinder to form the coil 23. Note that an inner diameter of the coil 23 is denoted as ϕ. The resonance frequency f0 was measured for each of the coils 23 having the inner diameter ϕ=1.0, 1.5, 2.0 mm, using the above-described measurement method. Here, the inner diameter ϕ of the coil 23 represents the diameter of the cylinder around which the winding wire 26 was wound. The pitch of the coil was set to 0.4 mm. Further, as shown in FIG. 4A, the resonance frequency f0 was measured while changing the overall length L of the winding wire 26. FIG. 4B shows the measurement results of the resonance frequency f0. As can be seen from FIG. 4B, the resonance frequency f0 does not significantly depends on the inner diameter ϕ of the coil 23, while it significantly depends on the overall length L of the winding wire 26. It is found from the measurement results that, in order to form the coil 23 having an effective length corresponding to a desired resonance frequency, the overall length L of the winding wire 26 should be adjusted and determined so that the following Expression 5 is satisfied.

Expression 5

$$L[\text{mm}] = \frac{216}{f0[\text{GHz}]} \qquad \text{Expression 5}$$

In the below description, it is assumed that the desired resonance frequency f0, namely, the resonance frequency that is desirably used for wireless communication is 1575 MHz, which is used for a GPS etc. When the resonance frequency f0 is 1575 MHz, it is found from FIG. 4B that the overall length L of the winding wire 26 is approximately 137 mm. This length is 1.4 times a half wavelength 95 mm of an electromagnetic wave of 1575 MHz in a free space. Note that it is readily apparent that the resonance frequency f0 is not limited to 1575 MHz. It is needless to say that the resonance frequency f0 may be set, for example, to the frequency that is used for wireless communication to which the antenna is applied.

Note that the value of the numerator constant (216) in Expression 5 also depends on the material and thickness of the winding wire and the coil pitch. Accordingly, the size of the coil 23 (the overall length L of the wining wire 26) is not limited to the above example, and is determined appropriately from the measurement results.

Quarter Wavelength Magnetic Current Antenna

As described above, the research findings of the present inventors make it possible to form the coil 23 that has an effective length corresponding to a desired resonance frequency f0. Then, based on the research findings, fabrication of a magnetic current antenna having an effective length corresponding to a quarter wavelength, and a magnetic current antenna having an effective length corresponding to a half wavelength will be described.

Figure 5A:
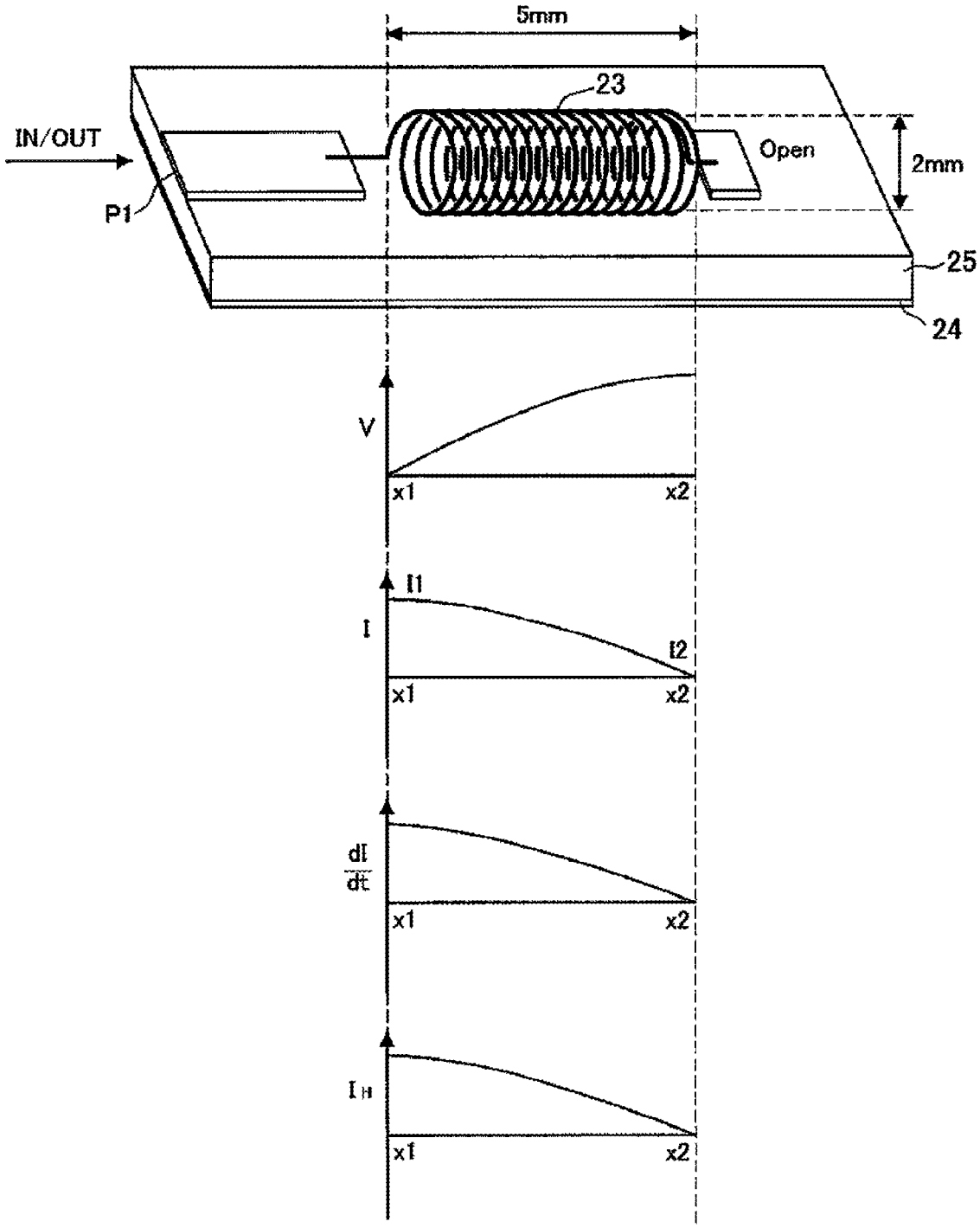
FIG. 5A is an explanatory diagram that illustrates a resonance state of a quarter wavelength antenna according to each embodiment of the present invention.
Figure 5B:
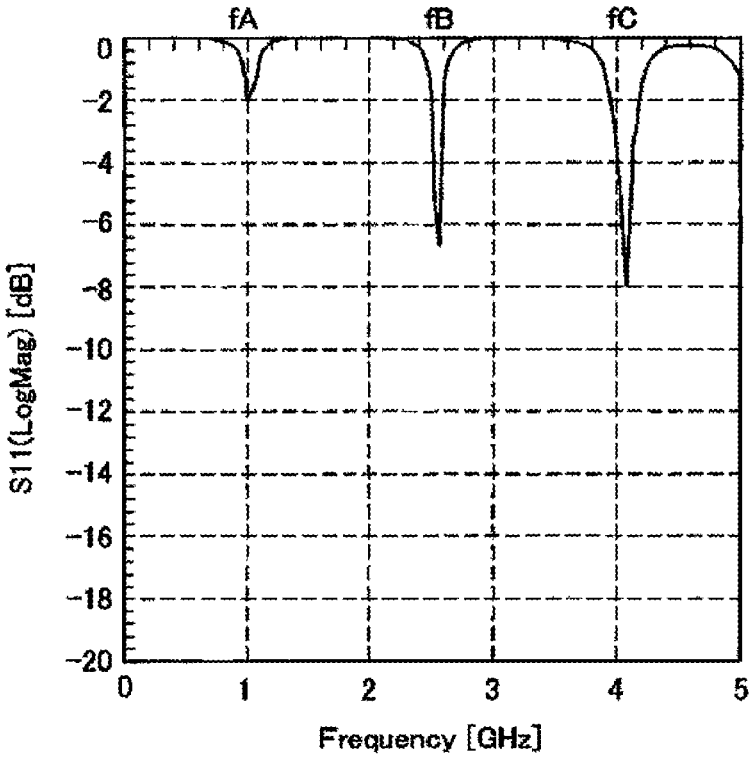
FIG. 5B is an explanatory diagram that illustrates the resonance state of the quarter wavelength antenna according to each embodiment of the present invention.
Figure 5C:
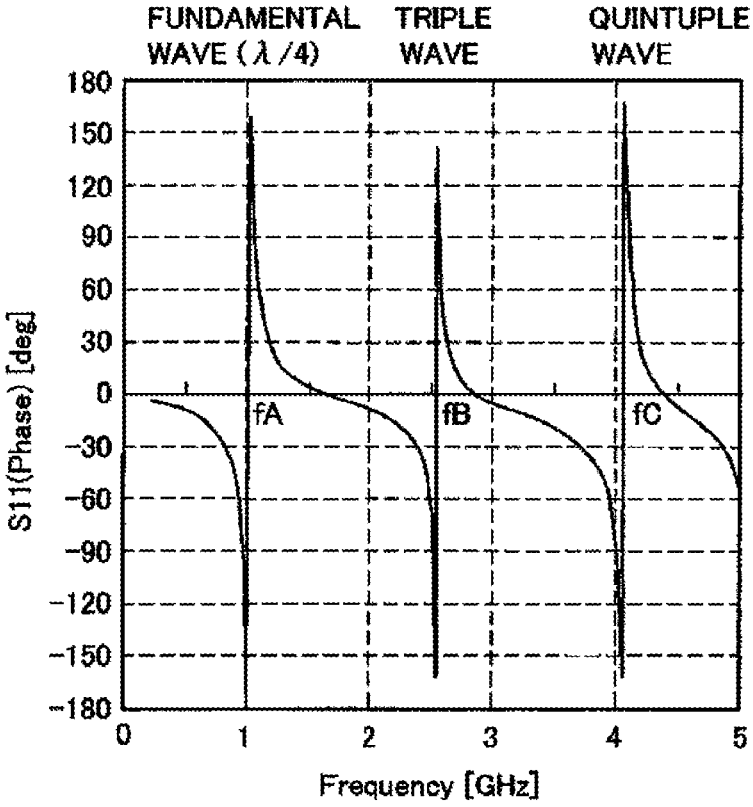
FIG. 5C is an explanatory diagram that illustrates the resonance state of the quarter wavelength antenna according to each embodiment of the present invention.

FIG. 5A to FIG. 5C are explanatory diagrams that illustrate a resonance state of a quarter wavelength antenna according to each embodiment of the present invention As shown in FIG. 5A, one end (the port P2) of the coil 23 is open to a ground 24, and a high frequency signal is input and output through the other end (the port P1). When the end x2 is open, x2 serves as a free end with respect to the voltage V, and serves as a fixed end with respect to the current I. Accordingly, x2 also serves as a fixed end with respect to the rate of change of the current dI/dt and the magnetic current $I_H$. Meanwhile, at the resonance frequency f0, the input/output port x1 serves as a fixed end with respect to the voltage V, and serves as a free end with respect to other factors, i.e., the current I, the rate of change of the current dI/dt, and the magnetic current $I_H$. Therefore, the mode of the standing wave occurring in the coil 23 is an odd number multiple of a quarter wavelength. FIG. 5B and FIG. 5C show measurement results of the resonance frequency f0. FIG. 5B and FIG. 5C show the measurement results of S11 (LogMag and Phase) of the S parameters, using the input/output port P1 as a reference plane.

It is found from FIG. 5B and FIG. 5C that, when the end x2 is open, resonation occurs at a high frequency that is an odd number multiple of the frequency of a fundamental wave (a wave of a frequency fA). Further, it is found that the coil 23 operates as a radiation element of the antenna, and radiates an electromagnetic wave having the resonance frequency fA or the like to the outside. To summarize, it is found that, in order to fabricate a magnetic current antenna having an effective length corresponding to a quarter wavelength, it is necessary to open the end and utilize the resonance of the fundamental wave.

Half Wavelength Magnetic Current Antenna

Next, fabrication of a half wavelength magnetic current antenna will be explained.

Figure 6A:
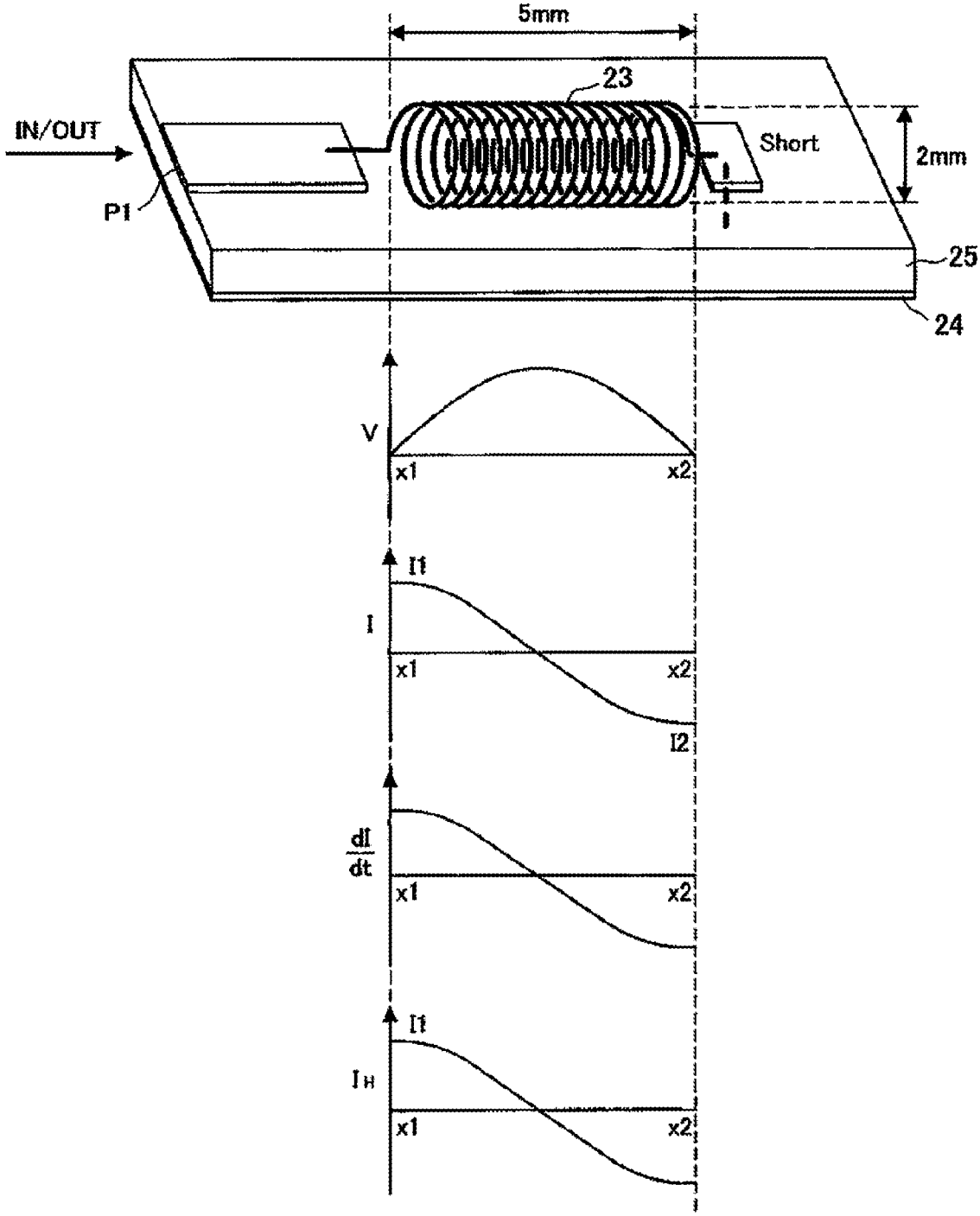
FIG. 6A is an explanatory diagram that illustrates a resonance state of a half wavelength antenna according to each embodiment of the present invention.
Figure 6B:
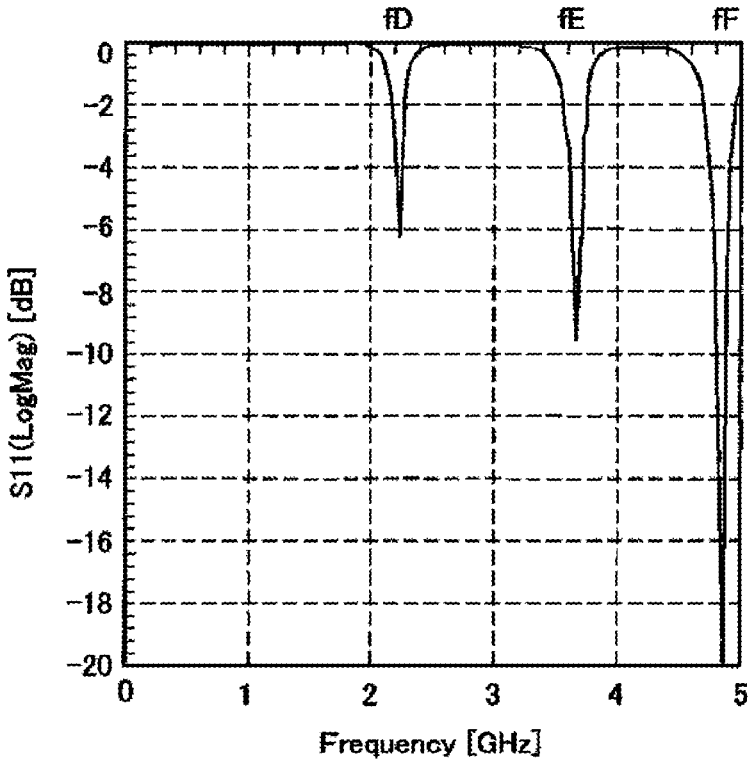
FIG. 6B is an explanatory diagram that illustrates the resonance state of the half wavelength antenna according to each embodiment of the present invention.
Figure 6C:
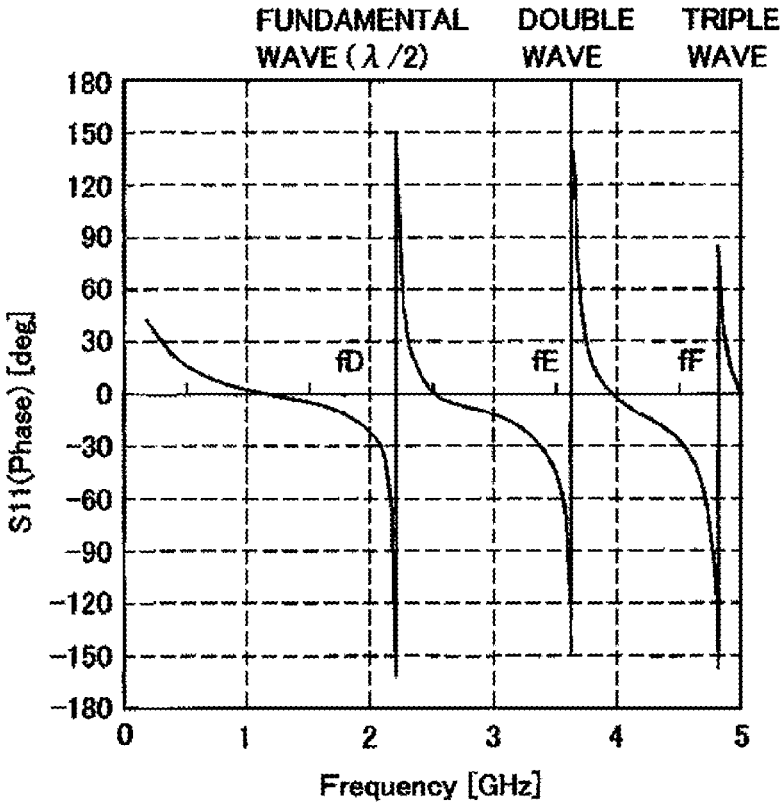
FIG. 6C is an explanatory diagram that illustrates the resonance state of the half wavelength antenna according to each embodiment of the present invention.

FIG. 6A to FIG. 6C are explanatory diagrams that illustrate a resonance state of a half wavelength antenna according to each embodiment of the present invention.

As shown in FIG. 6A, one end (the port P2) of the coil 23 is short circuited to the ground 24, and a high frequency signal is input and output through the other end (the port P1). When the end x2 is short circuited, x2 serves as a fixed end with respect to the voltage V (constantly 0V), and serves as a free end with respect to the current I. Accordingly, x2 also serves as a free end with respect to the rate of change of the current dI/dt and the magnetic current $I_H$. Meanwhile, at the resonance frequency f0, the input/output port x1 serves as a fixed end with respect to the voltage V, and serves as a free end with respect to other factors, i.e., the current I, the rate of change of the current dl/dt, and the magnetic current $I_H$. Therefore, the mode of the standing wave occurring in the coil 23 is an integral multiple of a half wavelength. FIG. 6B and FIG. 6C show measurement results of the resonance frequency f0. FIG. 6B and FIG. 6C show the measurement results of S11 (LogMag and Phase) of the S parameters, using the input/output port P1 as a reference plane.

It is found from FIG. 6B and FIG. 6C that, when the end x2 is short circuited, resonation occurs at a high frequency that is an integral multiple of the frequency of a fundamental wave (a wave of a frequency fD). Further, it is found that the coil 23 operates as a radiation element of the antenna, and radiates an electromagnetic wave having the resonance frequency fD or the like to the outside. To summarise, it is found that, in order to fabricate a magnetic current antenna having an effective length corresponding to a half wavelength, it is necessary to short circuit the end and utilize the resonance of the fundamental wave.

Input Impedance of the Half Wavelength Magnetic Current Antenna

Figure 7A:
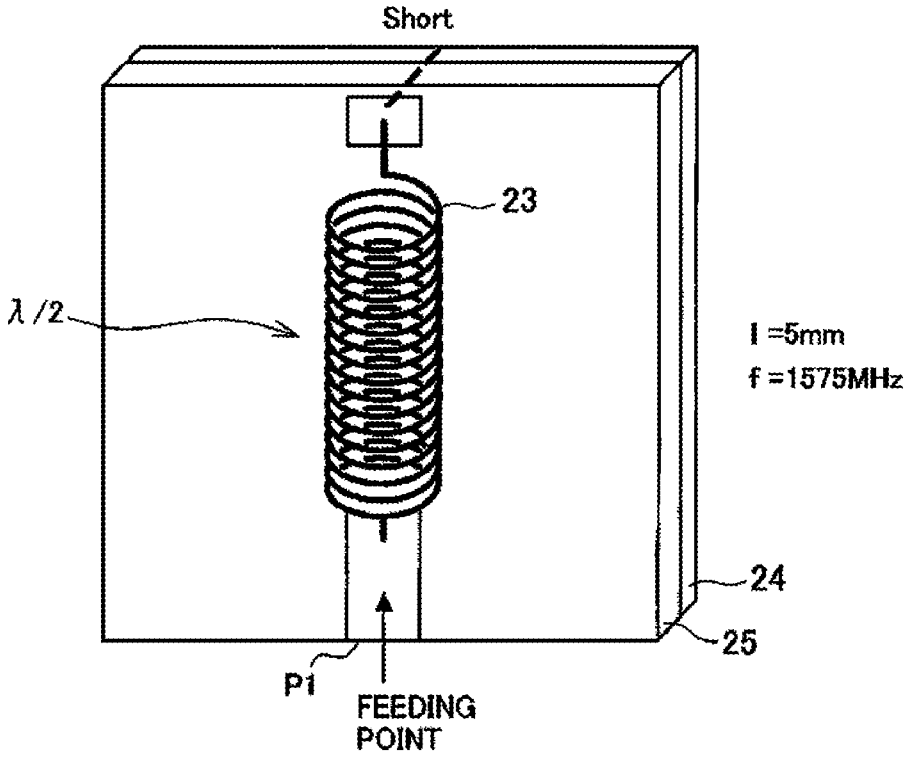
FIG. 7A is an explanatory diagram that illustrates a coil whose input impedance was measured when the antenna according to each embodiment of the present invention was fabricated.
Figure 7B:
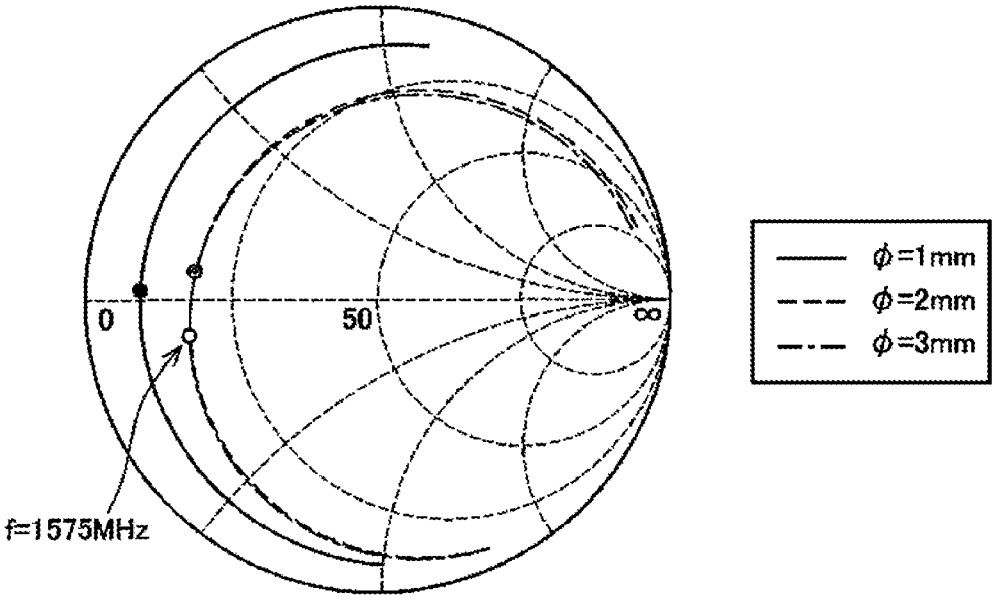
FIG. 7B is a diagram that shows a measurement result of the input impedance of the coil shown in FIG. 7A.
Figure 7C:
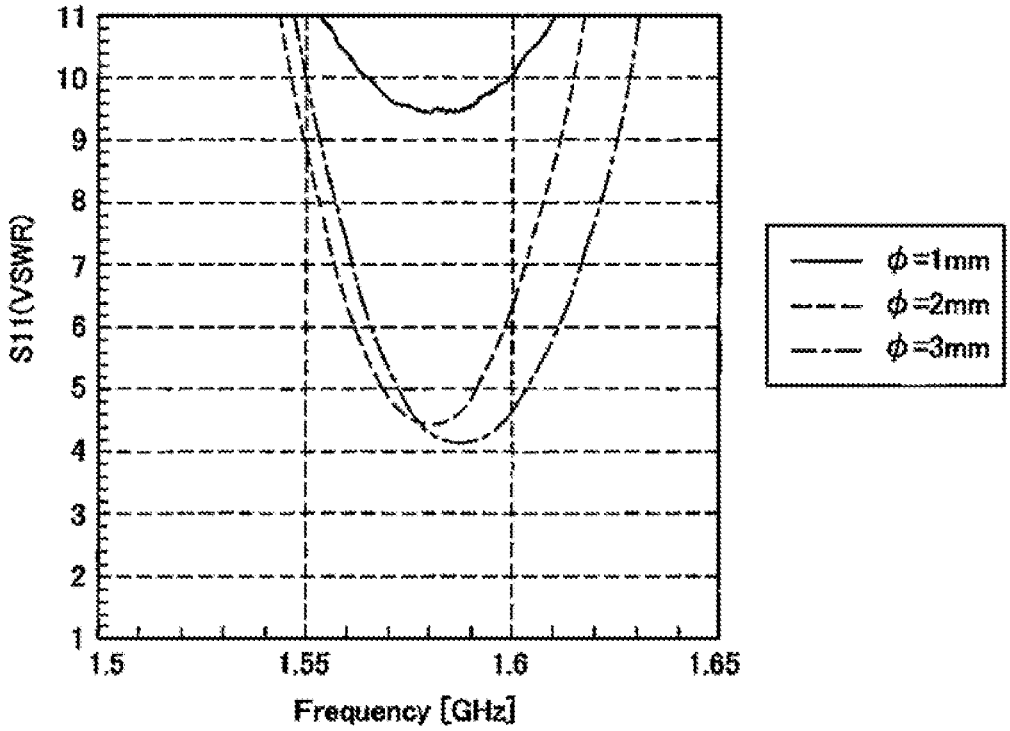
FIG. 7C is a diagram that shows a measurement result of a standing wave ratio of the coil shown in FIG. 7A.

Given the above, a half wavelength magnetic current antenna (the coil 23) that resonates at 1575 MHz was fabricated as shown in FIG. 7A, and characteristics of the coil 23 were measured. The coil 23 was formed by winding a copper wire having the overall length L of 137 mm. Further, the characteristics of each of the coils 23 whose inner diameter $\phi$=0.1, 1.5, 2.0 mm were measured, If one end (the port P2) of the coil 23 is short circuited, the other end is set as a feeding point, and a high frequency signal of 1575 MHz is input, a standing wave is generated in the coil 23 (refer to FIG. 6A). Therefore, the coil 23 operates as a magnetic current element that resonates at a half-wave length (an integral multiple of a half wavelength). FIG. 7B and FIG. 7C show measurement results of the input impedance when viewed from the feeding point at this time, and a standing wave ratio, respectively.

As can be seen from FIG. 7C, in the vicinity of the resonance frequency f0 of 1575 MHz, the voltage standing wave ratio (VSWR) becomes smaller, but it is larger than the VSWR=2, which is the value at which the coil 23 generally operates as an antenna. It is found from FIG. 7B that the input impedance when viewed from the feeding point (the port P1) is significantly smaller than 50Ω at 1575 MHz.

Figure 8A:
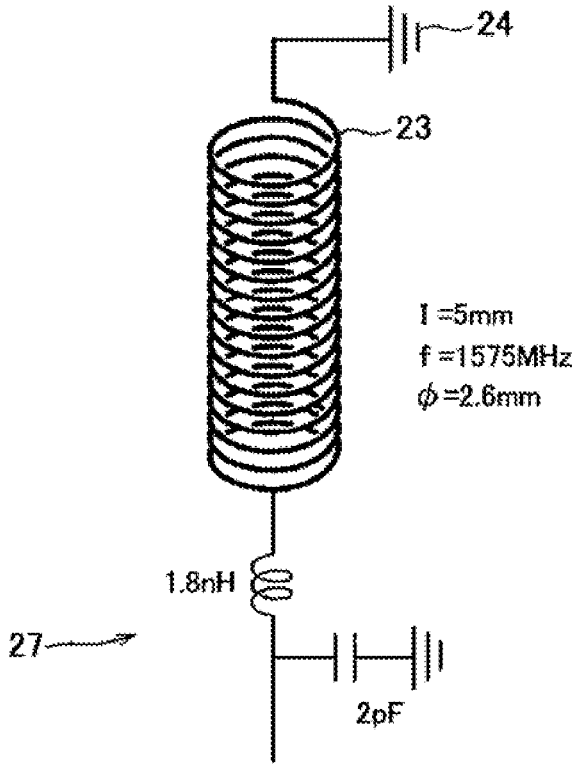
FIG. 8A is an explanatory diagram that illustrates the coil after matching whose input impedance was measured when the antenna according to each embodiment of the present invention was fabricated.
Figure 8B:
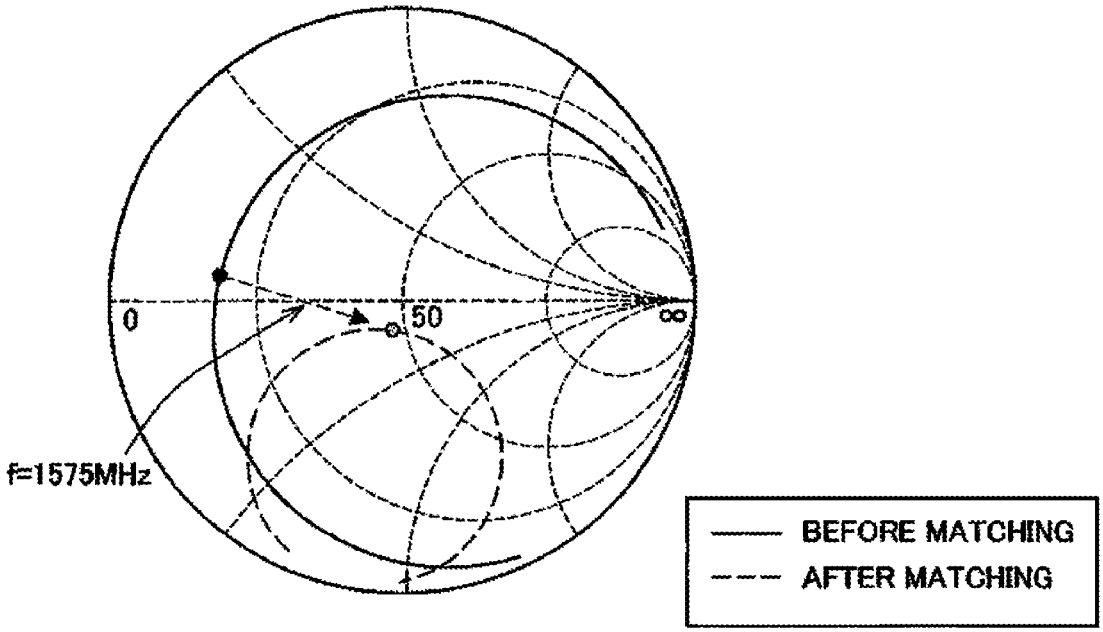
FIG. 8B is a diagram that shows a measurement result of the input impedance of the coil after matching shown in FIG. 8A.
Figure 8C:
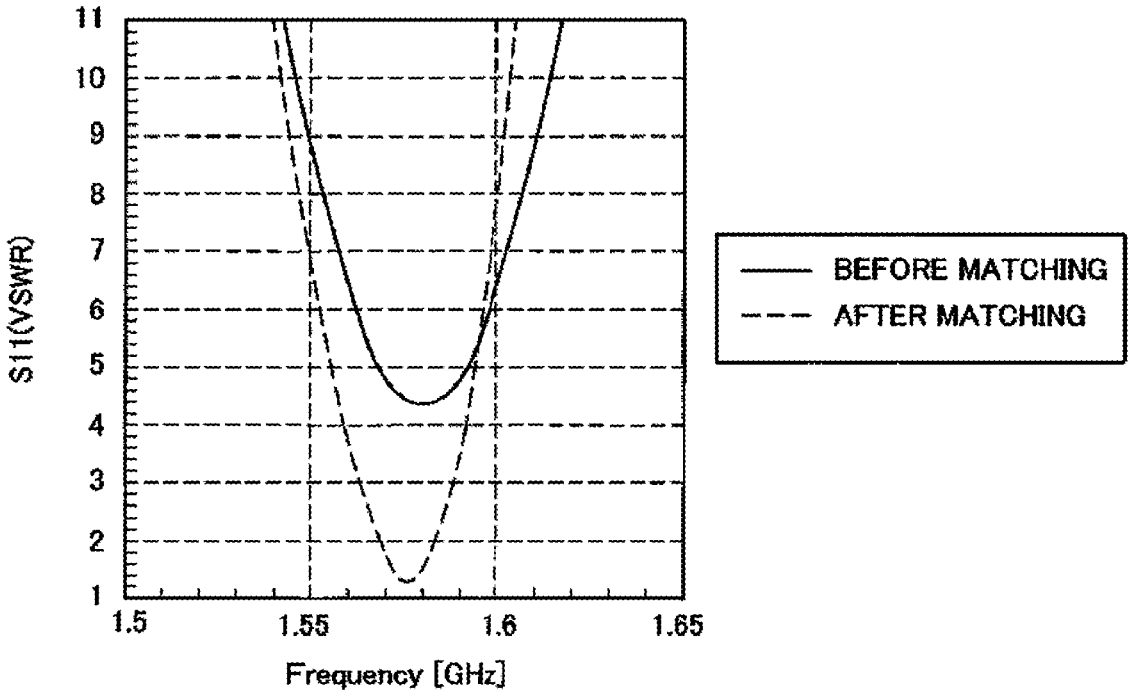
FIG. 8C is a diagram that shows a measurement result of a standing wave ratio of the coil after matching shown in FIG. 8A.

In addition, in order to use the coil 23 as a radiation element of a magnetic current antenna, it is necessary to connect a high frequency signal line to the feeding point (the port 1). For example, the impedance of a high frequency signal line, such as a coaxial cable, is approximately 50Ω. Therefore, it is necessary to reduce return loss by performing matching between the coil 23 and the signal line. In order to perform such an impedance matching, a matching circuit 27 shown in FIG. 8A was connected to the feeding point. FIG. 8A and FIG. 8C show the measurement results of the input impedance when viewed from the feeding point after connecting the matching circuit 27, and the standing wave ratio, respectively. Note that, in this case, the coil 23 having the diameter $\phi$ of 2.6 mm was used, and the length of the coil 23 was set to 8 mm (18 turns). Further, the size of the ground substrate was set to 20 mm×20 mm, and the thickness of the substrate was set to 0.8 mm.

As can be seen from FIG. 8C, the VSWR in the vicinity of the resonance frequency f0 of 1575 MHz becomes smaller than that before matching, and radiation efficiency is improved. In addition, it is found from FIG. 8B that the input impedance when viewed from the feeding point (the port P1) could be set to approximately 50Ω at 1575 MHz. Moreover, as can be seen from the aforementioned size and the like of the coil 23, this magnetic current antenna can be formed to be very small, as compared to a normal current antenna (a half wavelength dipole antenna, which has a half wavelength of 95 mm in the free space).

Note that the matching circuit 27 (refer to FIG. 8A) shown here is only an example, and it is needless to say that any circuit can be used as long as matching can be performed. Although the matching circuit 27 is not shown below for convenience of explanation, it is assumed that the matching circuit 27 is connected to a feeding point in the measurements described later.

Radiation Gain of the Half Wavelength Magnetic Current Antenna

Next, the radiation gain of the magnetic current antenna fabricated as described above will be described.

Figure 9A:
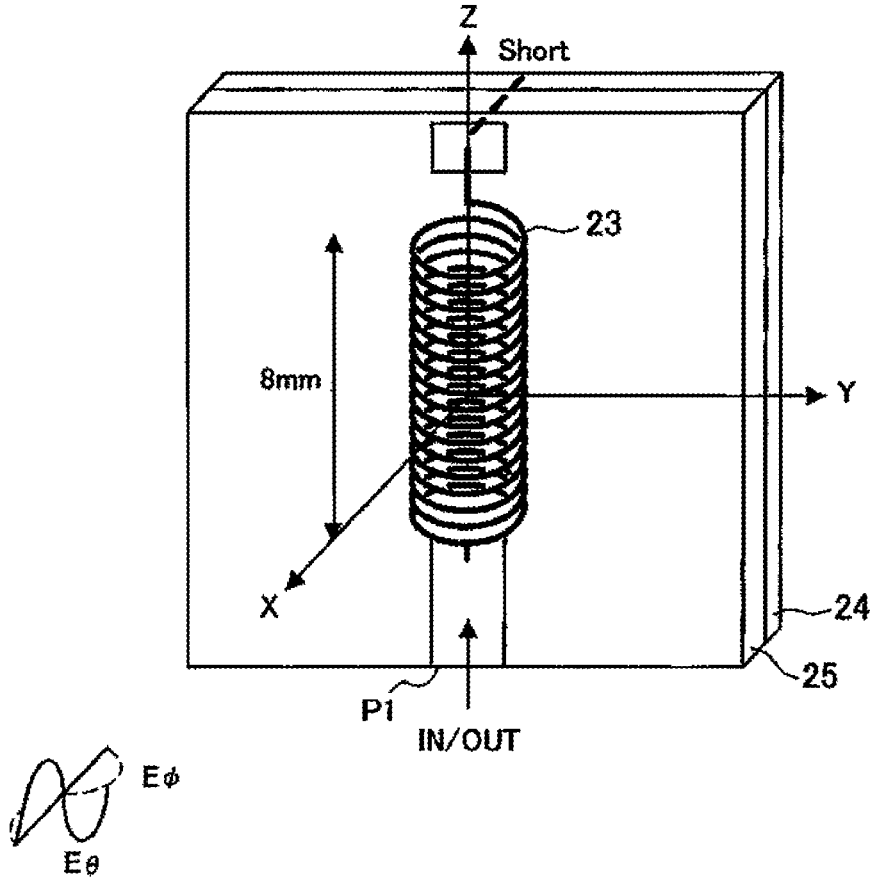
FIG. 9A is an explanatory diagram that illustrates a coil whose radiation gain was measured when the antenna according to each embodiment of the present invention was fabricated.
Figure 9B:
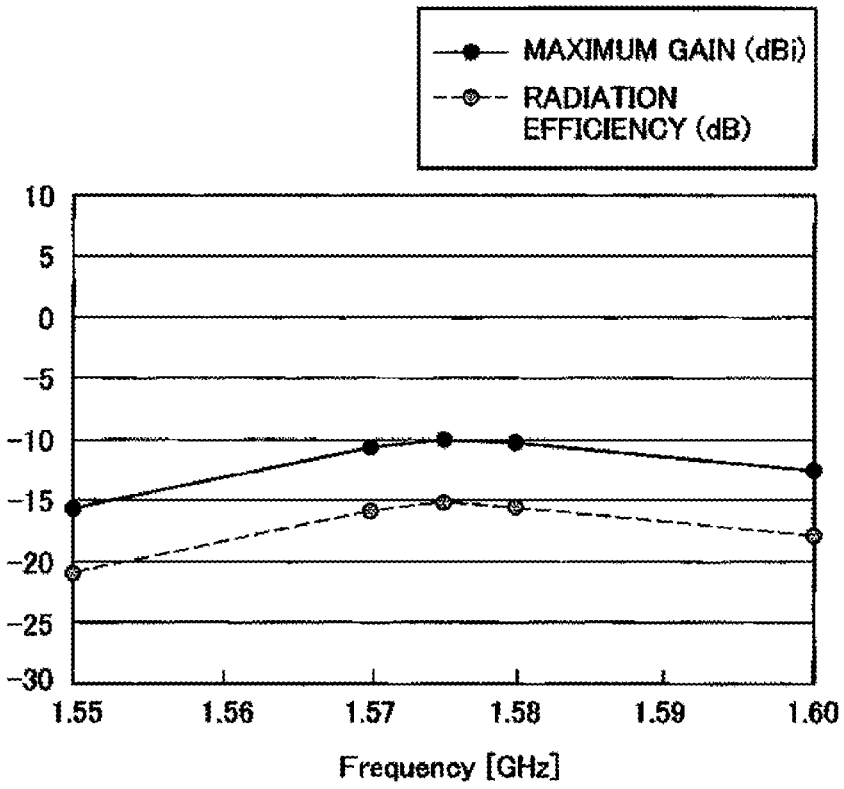
FIG. 9B is a diagram that shows a measurement result of the radiation gain of the coil shown in FIG. 9A.
Figure 9C:
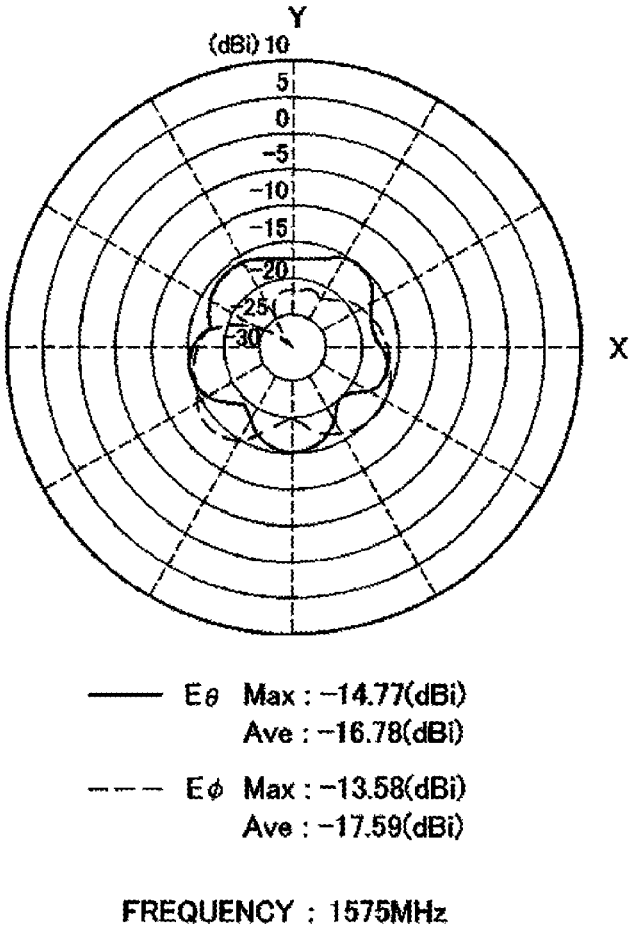
FIG. 9C is a diagram that shows a measurement result of the radiation gain of the coil shown in FIG. 9A.
Figure 9D:
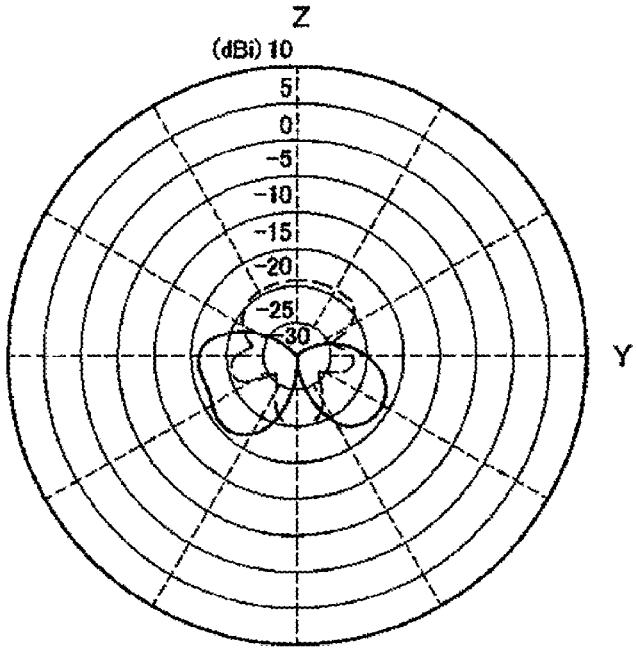
FIG. 9D is a diagram that shows a measurement result of the radiation gain of the coil shown in FIG. 9A.
Figure 9E:
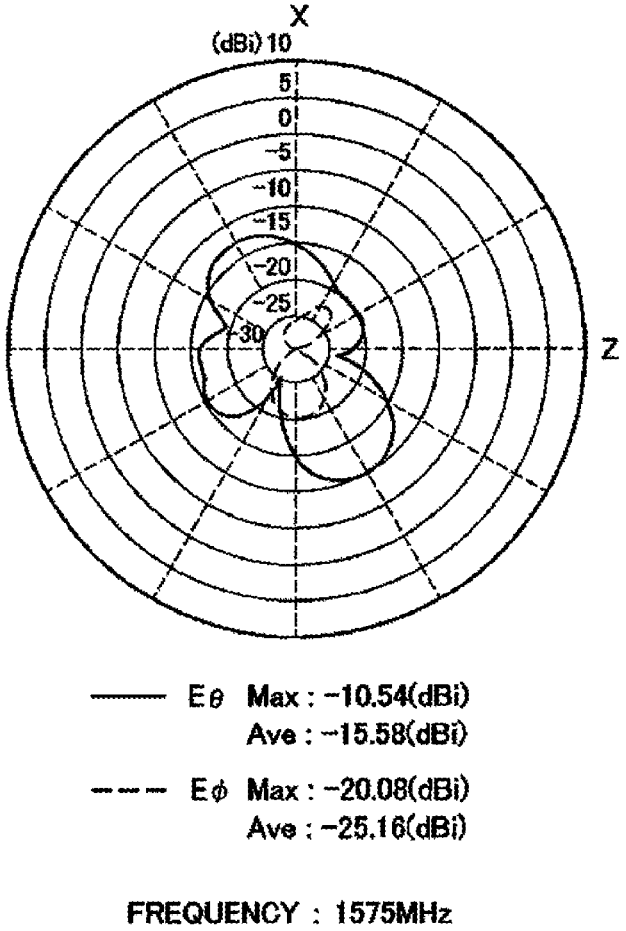
FIG. 9E is a diagram that shows a measurement result of the radiation gain of the coil shown in FIG. 9A.

FIG. 9A is an explanatory diagram that illustrates a coil whose radiation gain was measured when the antenna according to each embodiment of the present invention was fabricated. FIG. 9B to FIG. 9E are diagrams each showing a measurement result of the radiation gain of the coil shown in FIG. 9A.

As shown in FIG. 9A, radiation efficiency was measured such that the coil axis of the coil 23 fabricated as described above was vertically aligned and taken as the Z axis, the direction extending vertically from the substrate 25 toward the coil 23 was taken as the X axis, and the direction perpendicular to the Z axis and the X axis was taken as the Y axis. As a result, it was found that the coil 23 operates as a radiation element, and is able to radiate an electromagnetic wave of the resonance frequency f0 (1575 MHz) as shown in FIG. 9B to FIG. 9E. However, the present inventors intended to further improve the radiation efficiency (average gains of the three planes of XY, YZ and ZX, shown in FIG. 9C to FIG. 9E).

Figure 10:
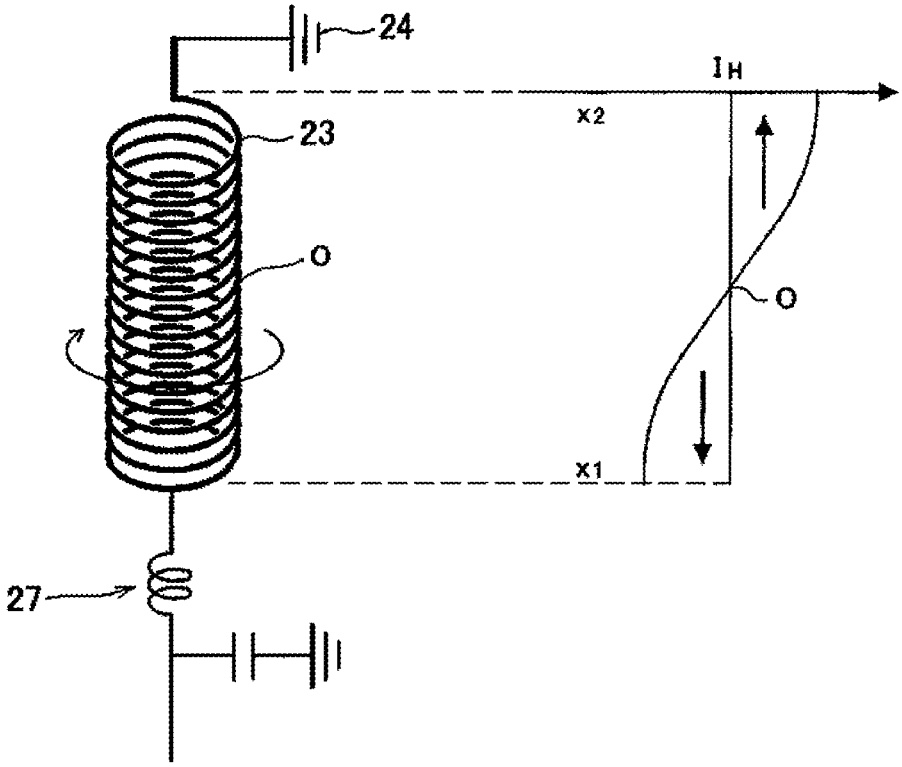
FIG. 10 is an explanatory diagram that illustrates a magnetic current direction of the half wavelength antenna according to each embodiment of the present invention.

FIG. 10 is an explanatory diagram that illustrates a magnetic current direction of the half wavelength antenna according to each embodiment of the present invention.

As shown in FIG. 10, when a standing wave is generated in a half wavelength coil having a short-circuited end, the magnetic current $I_H$ generated by the coil 23 has a waveform of a half wavelength. The ends x1 and x2 of the coil 23 become anti-nodes of the magnetic current $I_H$, and a center O of the coil 23 becomes a node of the magnetic current $I_H$. The direction of the magnetic current $I_H$ is reversed with the node serving as a boundary. Accordingly, it can be understood that an upper half of the magnetic current $I_H$ and a lower half of the magnetic current $I_H$ cancel each other out, with the center O of the coil 23 serving as the boundary.

In a normal current antenna (for example, a dipole antenna), it is difficult to partially reverse the flow direction of an electric current in order to inhibit mutual cancellation. However, the present inventors conceived of the idea that the direction of the magnetic current $I_H$ can be controlled by changing the turning direction of the coil 23 (the winding direction of the winding wire 26), and further improved the coil 23. Thus, the present inventors fabricated an antenna 100 according to a first embodiment of the present invention. Next, the antenna 100 will be described.

Antenna 100 According to the First Embodiment

Figure 11A:
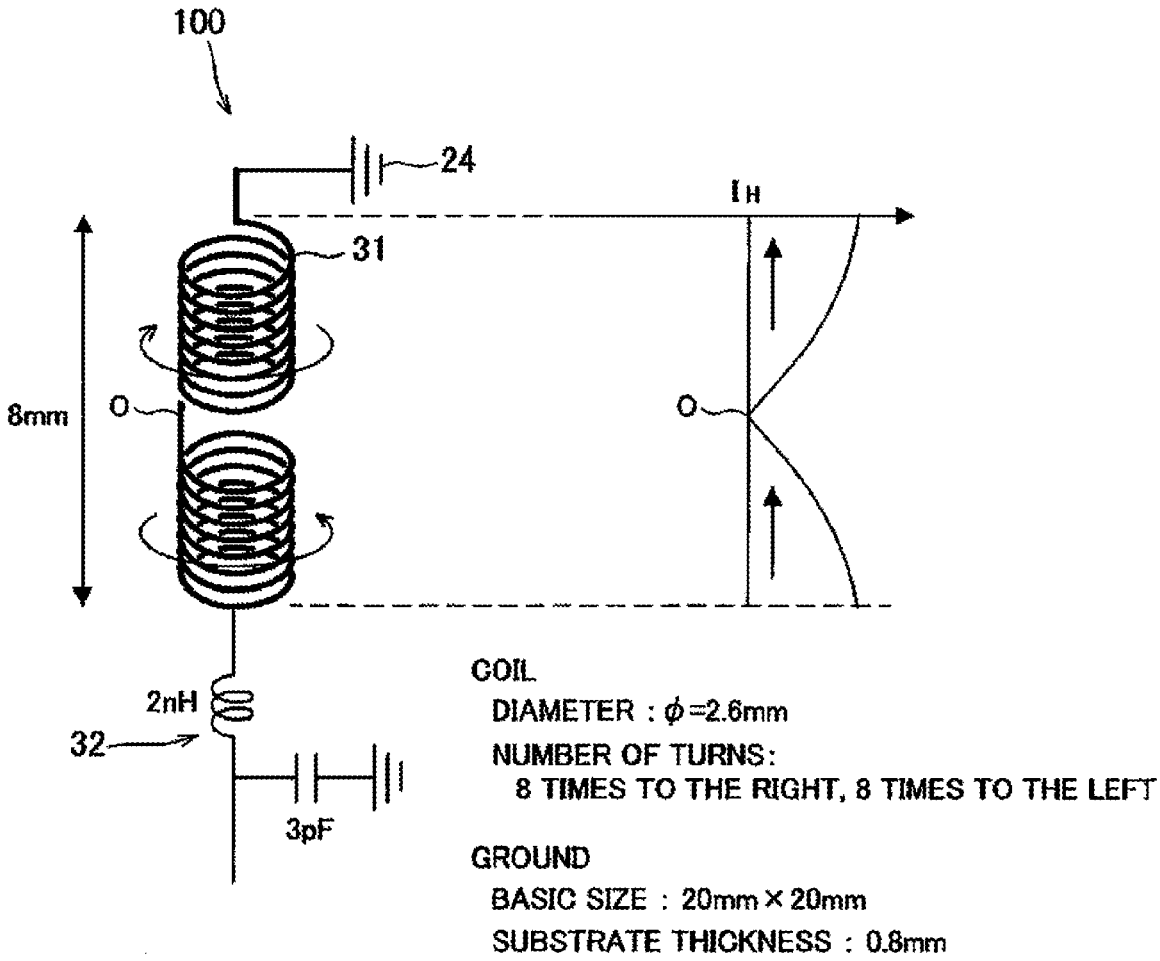
FIG. 11A is an explanatory diagram that illustrates an antenna according to a first embodiment of the present invention.
Figure 11B:
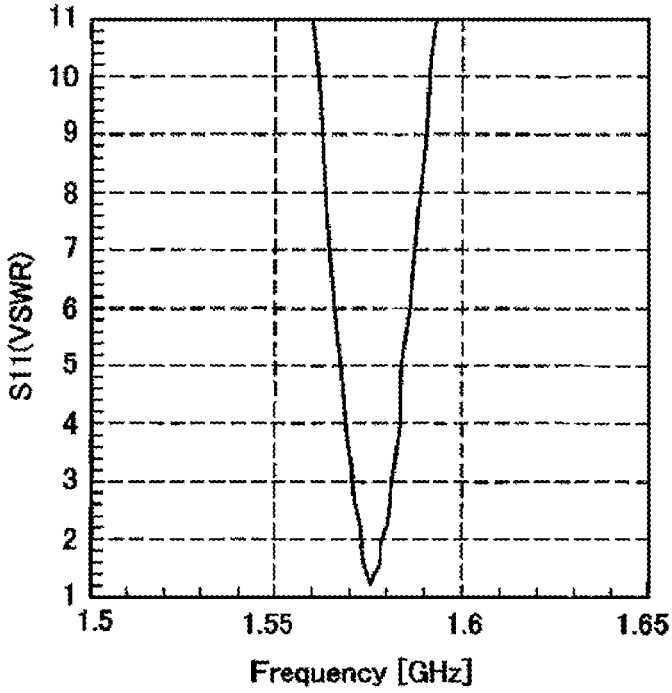
FIG. 11B is a diagram that shows a measurement result of a standing wave ratio of the antenna shown in FIG. 11A.

FIG. 11A is an explanatory diagram that illustrates the antenna 100 according to the first embodiment of the present invention. FIG. 11B is a diagram that shows a measurement result of a standing wave ratio of the antenna 100 shown in FIG. 11A.

As shown in FIG. 11A, the antenna 100 according to the first embodiment of the present invention includes a coil 31 and a matching circuit 32.

In the same manner as in the above-described coil 23, one end (on the port P2 side) of the coil 31 is short-circuited, and the overall length L of the winding wire 26 is determined so that the coil 31 has an effective length corresponding to a half wavelength. Further, the matching circuit 32 is connected to the other end of the coil 31. The matching circuit 32 is formed to adjust an input impedance of the coil 31, in the same manner as in the above-described matching circuit 27.

Like the above-described coil 23, the coil 31 is placed on the substrate 25 that has a bottom surface on which the ground 24 is formed, and is connected to the port P1 (not shown in the figures) having one end formed with a micro strip line.

In order to further improve radiation efficiency of the coil 31 than that of the coil 32, unlike the coil 23, the coil 31 is formed such that the winding wire 26 is wound in a turning direction that is reversed, with the center O of the coil 31, namely, the half point of the winding wire 26, serving as a boundary. That is, the coil 31 is formed by reversing the turning direction at the center of the coil 31. In the coil 23 shown in FIG. 10, the number of turns was 18, and the turning direction of the winding wire 26 was all the same. On the other hand, the coil 31 of the present embodiment is formed such that, if the number of turns of the coil 31 is 18, the winding wire 26 is wound in the clockwise direction 9 times to the half point, and the remaining half thereof is wound in the counterclockwise direction 9 times. In other words, the coil 31 is formed by reversing the winding direction of the coil 23 shown in FIG. 10, using the node position of the standing wave of the magnetic current $I_H$ as the boundary. Note that, in this case, the coil 31 can also be formed by connecting in series two coils that have opposite turning directions. However, it is preferable that two coils are connected such that their coil axes are aligned on the same straight line.

If a high frequency signal of the resonance frequency f0 (for example, 1575 MHz) is input from a feeding point, a standing wave of the magnetic current $I_H$ occurs in the coil 31, in the same manner as in the coil 23. As shown in FIG. 11A, the directions of the magnetic current Iii (namely, the directions of the magnetic field H) in the standing wave become the same in the coil 31 because the turning direction of the coil 31 is reversed. In other words, the directions of the magnetic current $I_H$ can be aligned by reversing the turning direction of the coil 31 using the node position of the magnetic current $I_H$ as the boundary. As a result, the coil 31 can inhibit the cancelling out of the magnetic current $I_H$ in the coil 31. Thus, radiation efficiency can further be improved.

In addition, as can be seen from FIG. 11B, there is no change in that the VSWR becomes small at the resonance frequency f0 (1575 MHz). That is, it is found that, even if the turning direction of the coil is reversed, the resonance frequency f0 does not change.

Note that, normally, if a current antenna is arranged near a metal plate (for example, the ground 24) such that the current direction is in parallel with the metal plate), current flows on the metal plate such that it interferes with the operation of the current antenna, resulting in deteriorated characteristics. On the other hand, the antenna 100 utilizes the magnetic current $I_H$. Accordingly, even if the antenna 100 is arranged near the metal plate such that the direction of the magnetic current $I_H$ is in parallel with the metal plate, magnetic current does not flow on the metal plate. Therefore, the operation of the antenna is not interfered with. Thus, the antenna 100 can be arranged close to the ground 24 in parallel therewith. Therefore, the antenna 100 makes it possible to reduce the size of the entire system.

Radiation Gain of the Half-Wavelength Antenna 100 According to the Present Embodiment Next, a radiation gain of the antenna 100 according to the present embodiment will be described.

Figure 12A:
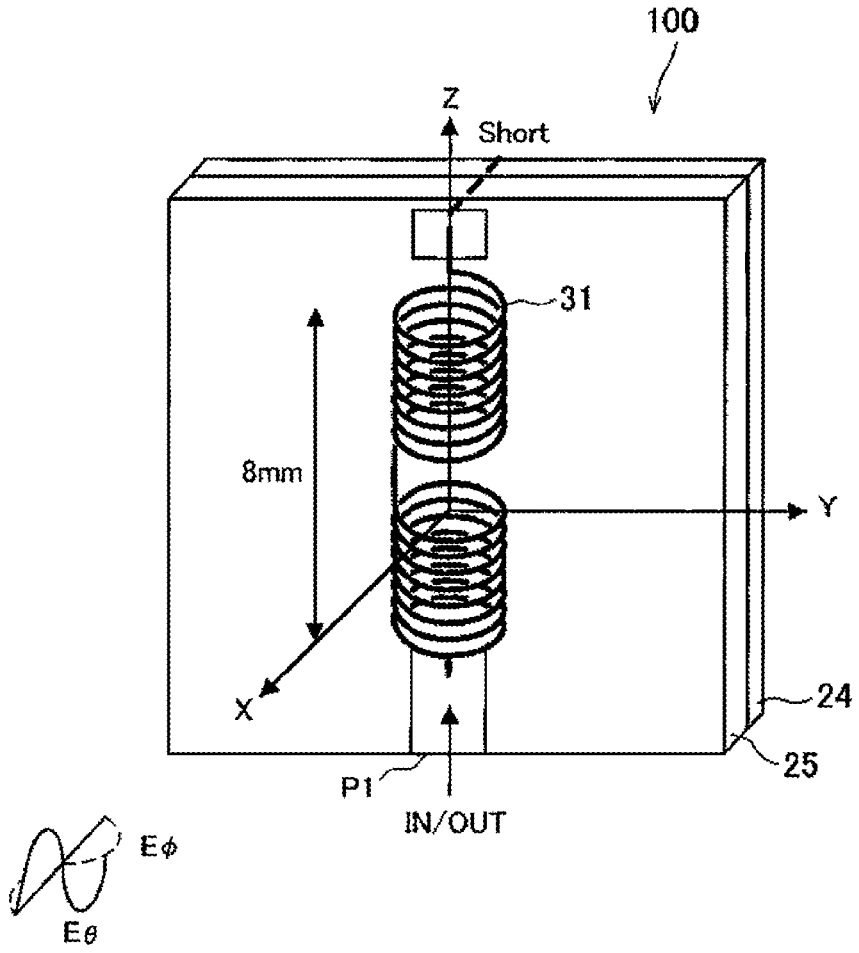
FIG. 12A is an explanatory diagram that illustrates an arrangement when a radiation gain of the antenna according to the first embodiment is measured.
Figure 12B:
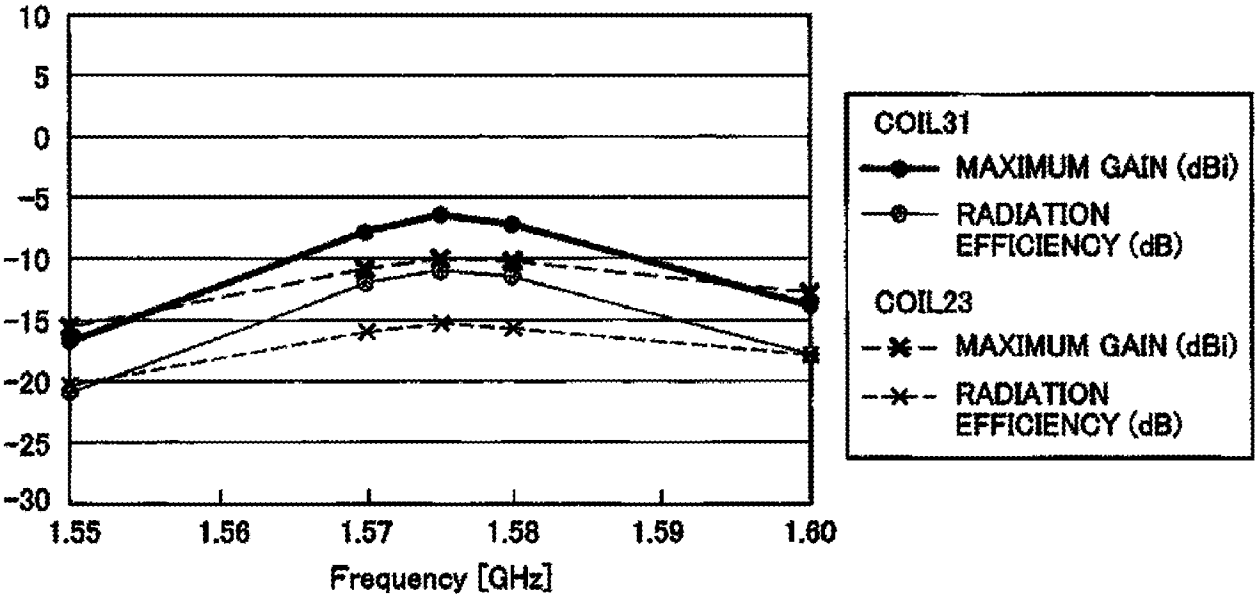
FIG. 12B is a diagram that shows a measurement result of the radiation gain of the antenna shown in FIG. 12A.
Figure 12C:
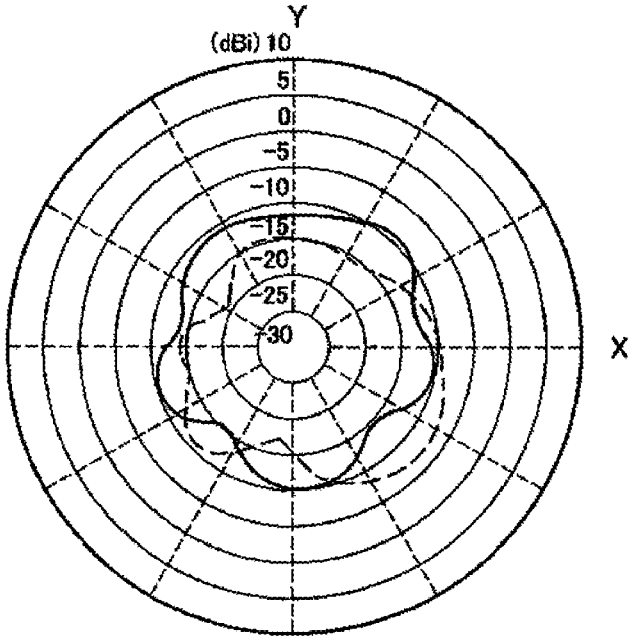
FIG. 12C is a diagram that shows a measurement result of the radiation gain of the antenna shown in FIG. 12A.
Figure 12D:
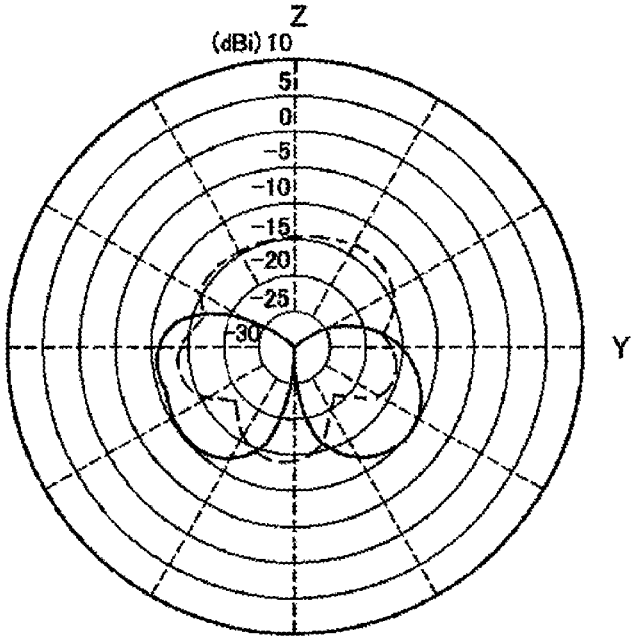
FIG. 12D is a diagram that shows a measurement result of the radiation gain of the antenna shown in FIG. 12A.
Figure 12E:
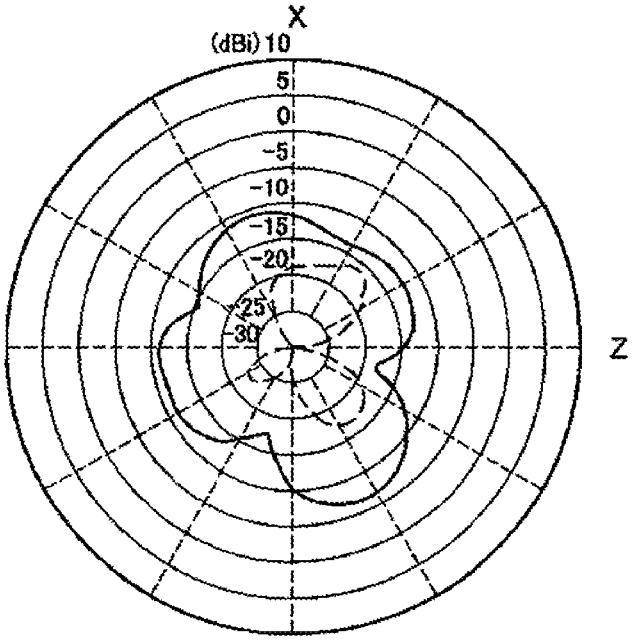
FIG. 12E is a diagram that shows a measurement result of the radiation gain of the antenna shown in FIG. 12A.

FIG. 12A is an explanatory diagram that illustrates an arrangement when a radiation gain of the antenna 100 according to the first embodiment of the present invention is measured. FIG. 12B to FIG. 12E are diagrams each showing a measurement result of the radiation gain of the antenna 100 shown in FIG. 12A As shown in FIG. 12A, radiation efficiency was measured such that the coil axis of the coil 31 provided in the antenna 100 of the present embodiment was vertically aligned and taken as the Z axis, the direction extending vertically from the substrate 25 toward the coil 31 was taken as the X axis, and the direction perpendicular to the Z axis and the X axis was taken as the Y axis. As a result, it was found that the coil 31 also operates as a radiation element, and is able to radiate an electromagnetic wave of the resonance frequency f0 (1575 MHz) as shown in FIG. 12B to FIG. 12E. As can be seen from FIG. 12B, and comparison of FIGS. 12C to 12E with FIGS. 9C to 9E, the radiation gain of the coil 31 can be improved by 4 to 5 dB as compared to that of the coil 23, by reversing the turning direction of the coil 31 at the center thereof.

The present inventors further conducted painstaking research to further improve the radiation gain of the antenna 100 according to the present embodiment. As a result, an antenna 200 according to a second embodiment of the present invention was fabricated. Next, the antenna 200 will be described.

Antenna 200 According to the Second Embodiment

Figure 13A:
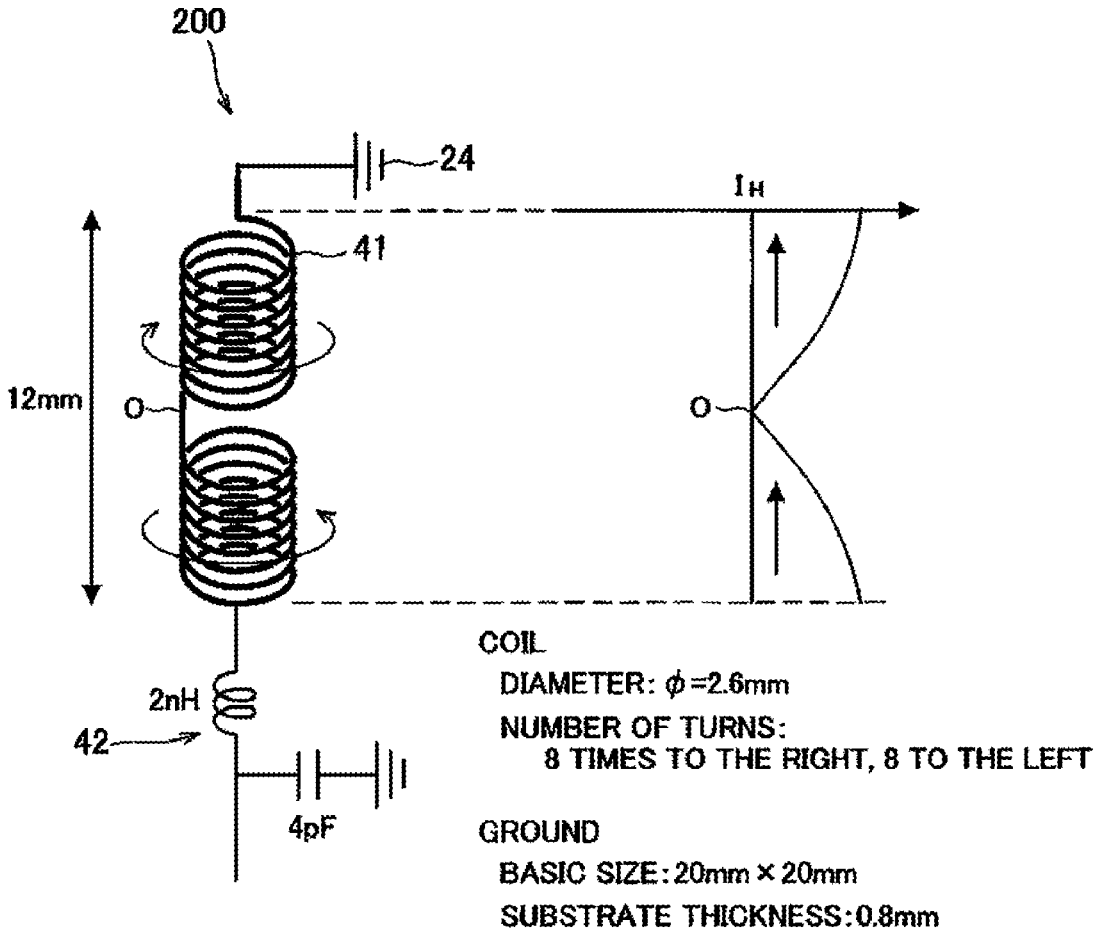
FIG. 13A is an explanatory diagram that illustrates an antenna according to a second embodiment of the present invention.
Figure 13B:
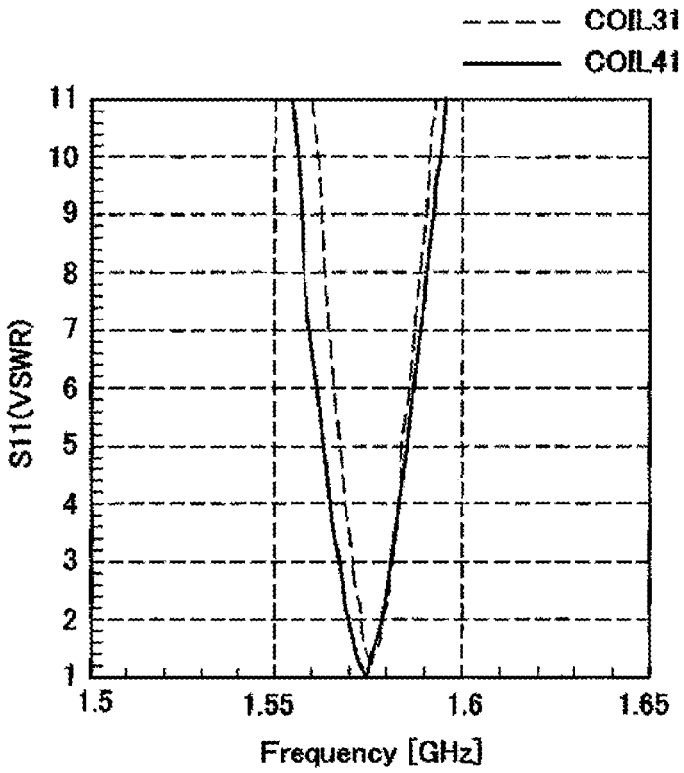
FIG. 13B is a diagram that shows a measurement result of a standing wave ratio of the antenna shown in FIG. 13A.

FIG. 13A is an explanatory diagram that illustrates the antenna 200 according to the second embodiment of the present invention. FIG. 13B is a diagram that shows a measurement result of a standing wave ratio of the antenna 200 shown in FIG. 13A.

As shown in FIG. 13A, the antenna 200 according to the second embodiment of the present invention includes a coil 41 and a matching circuit 42.

The coil 41 is formed by extending the coil length L (namely, the element length, refer to FIG. 4A) of the coil 31 provided in the antenna 100 according to the first embodiment. More specifically, the coil 41 is formed by enlarging the pitch of the coil 31 to elongate the radiation element, without changing the inner diameter $\phi$ of the coil 31. Therefore, the number of turns of the coil 41 was set to 16 (18 in the coil 31). That is, the coil 41 is formed such that the winding wire 26 is wound in the clockwise direction 8 times to the half point, and the remaining half thereof is wound in the counterclockwise direction 8 times. Further, the matching circuit 42 is formed to adjust an input impedance of the coil 41, in the same manner as in the above-described matching circuit 27.

The other structural elements of the antenna 200 according to the second embodiment are the same as those of the antenna 100 according to the first embodiment. Therefore, a detailed explanation thereof is omitted.

In addition, as can be seen from FIG. 13B, there is no change in that the VSWR becomes small at the resonance frequency f0 (1575 MHz).

Radiation Gain of the Half-Wavelength Antenna 200 According to the Present Embodiment Next, a radiation gain of the antenna 200 according to the present embodiment will be described.

Figure 14A:
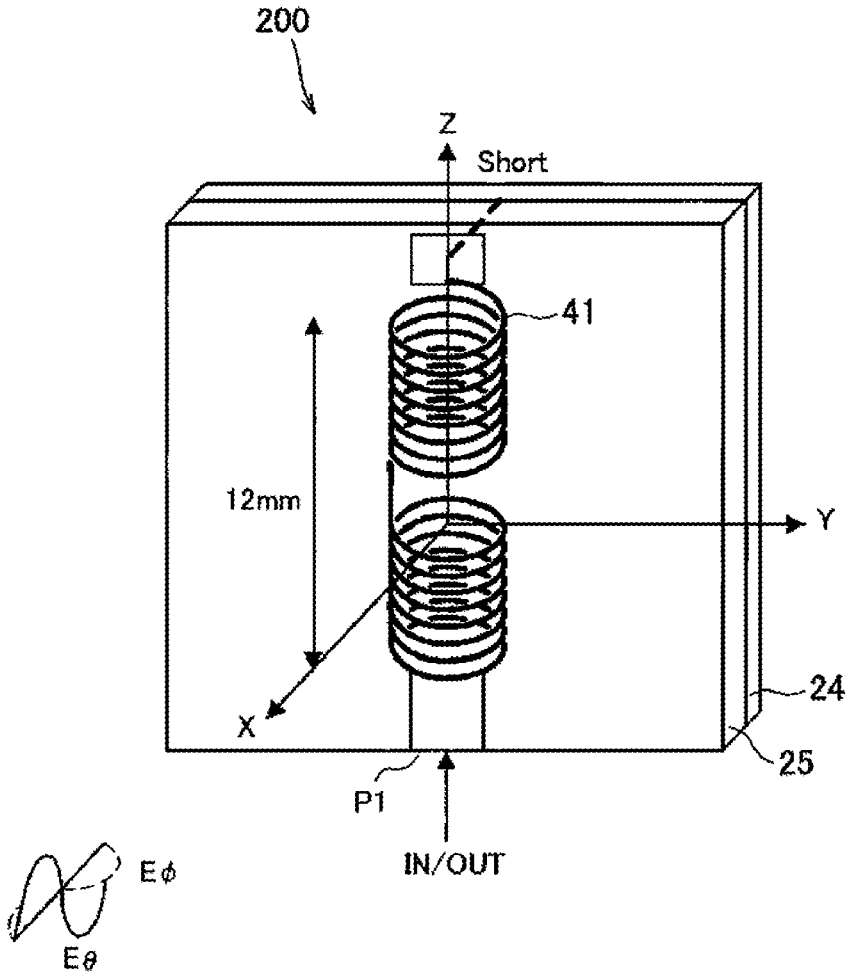
FIG. 14A is an explanatory diagram that illustrates an arrangement when a radiation gain of the antenna according to the second embodiment is measured.
Figure 14B:
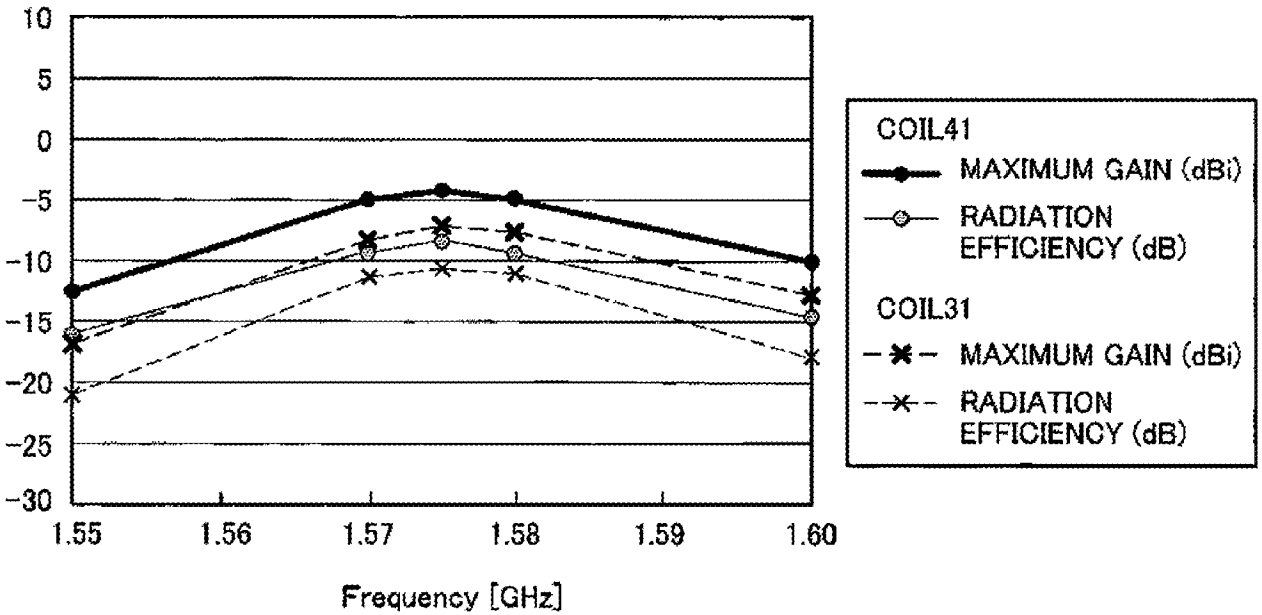
FIG. 14B is a diagram that shows a measurement result of the radiation gain of the antenna shown in FIG. 14A.
Figure 14C:
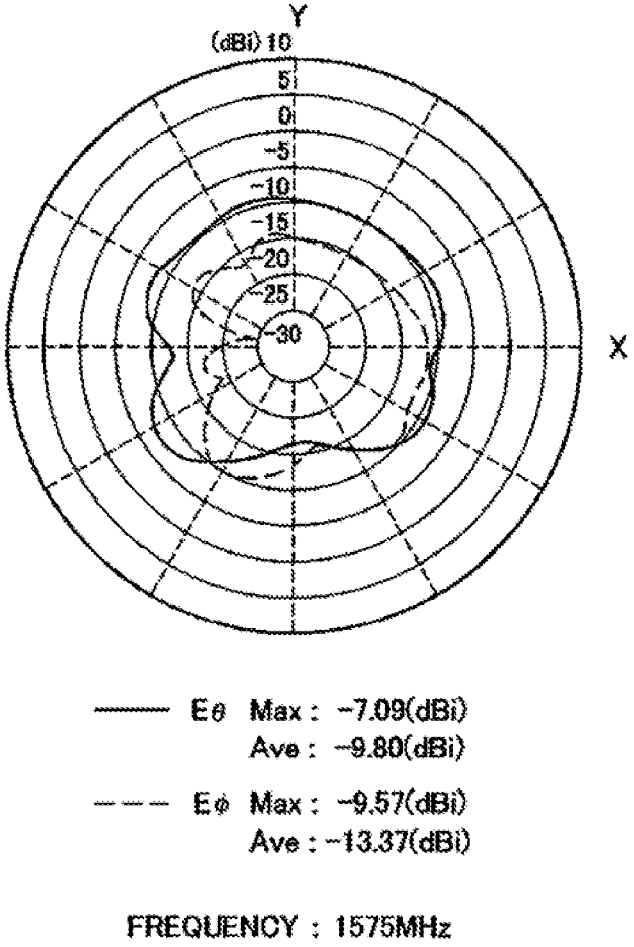
FIG. 14C is a diagram that shows a measurement result of the radiation gain of the antenna shown in FIG. 14A.
Figure 14D:
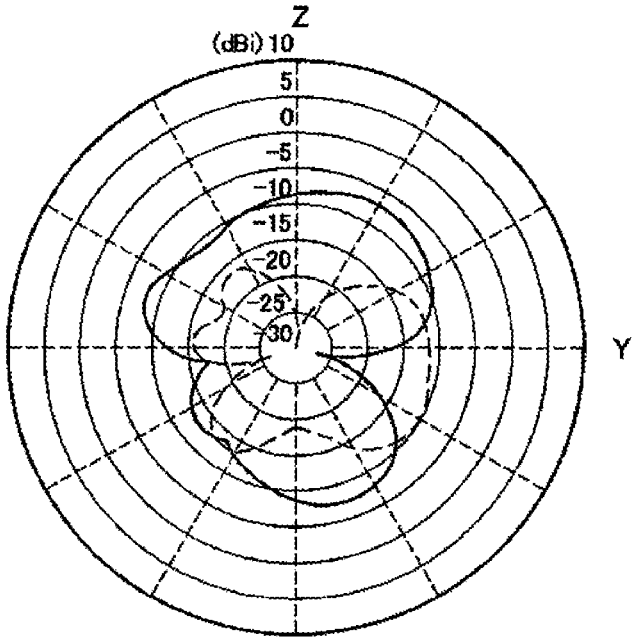
FIG. 14D is a diagram that shows a measurement result of the radiation gain of the antenna shown in FIG. 14A.
Figure 14E:
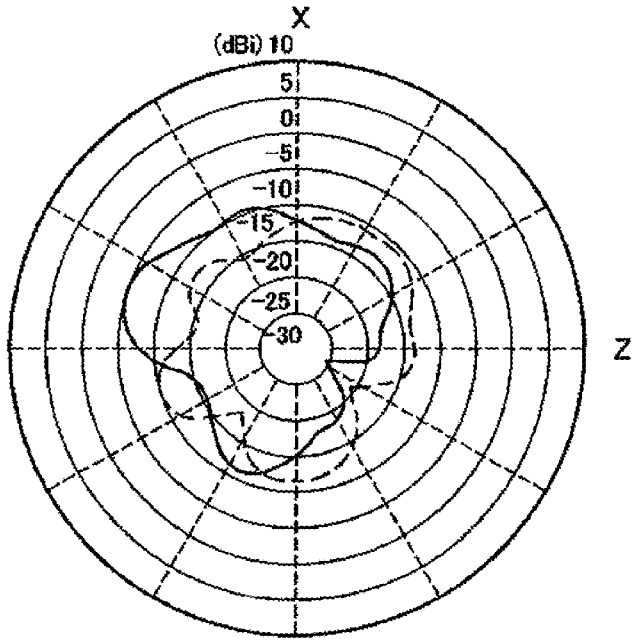
FIG. 14E is a diagram that shows a measurement result of the radiation gain of the antenna shown in FIG. 14A.

FIG. 14A is an explanatory diagram that illustrates an arrangement when a radiation gain of the antenna 200 according to the second embodiment of the present invention is measured. FIG. 14B to FIG. 14E are diagrams each showing a measurement result of the radiation gain of the antenna 200 shown in FIG. 14A.

As shown in FIG. 14A, radiation efficiency was measured such that the coil axis of the coil 41 provided in the antenna 200 of the present embodiment was vertically aligned and taken as the Z axis, the direction extending vertically from the substrate 25 toward the coil 41 was taken as the X axis, and the direction perpendicular to the Z axis and the X axis was taken as the Y axis. As a result, it is found that the coil 41 also operates as a radiation element, and is able to radiate an electromagnetic wave of the resonance frequency f0 (1575 MHz) as shown in FIG. 14B to FIG. 14E. As can be seen from FIG. 14B, and comparison of FIGS. 14C to 14E with FIGS. 12C to 12E, the radiation gain of the coil 41 can be improved by 2 to 3 dB as compared to that of the coil 31, by forming the coil 41 to be 1.5 times longer than the coil length L of the coil 31.

Performance of the Antenna 200 According to the Present Embodiment

In order to measure the performance of the antenna 200 of the present embodiment fabricated as described above, the antenna 200 was installed in a commercially available GPS receiver, and comparative experiments were carried out to compare the antenna 200 with a patch antenna of the related art that was originally installed in the GPS receiver.

Figure 15A:
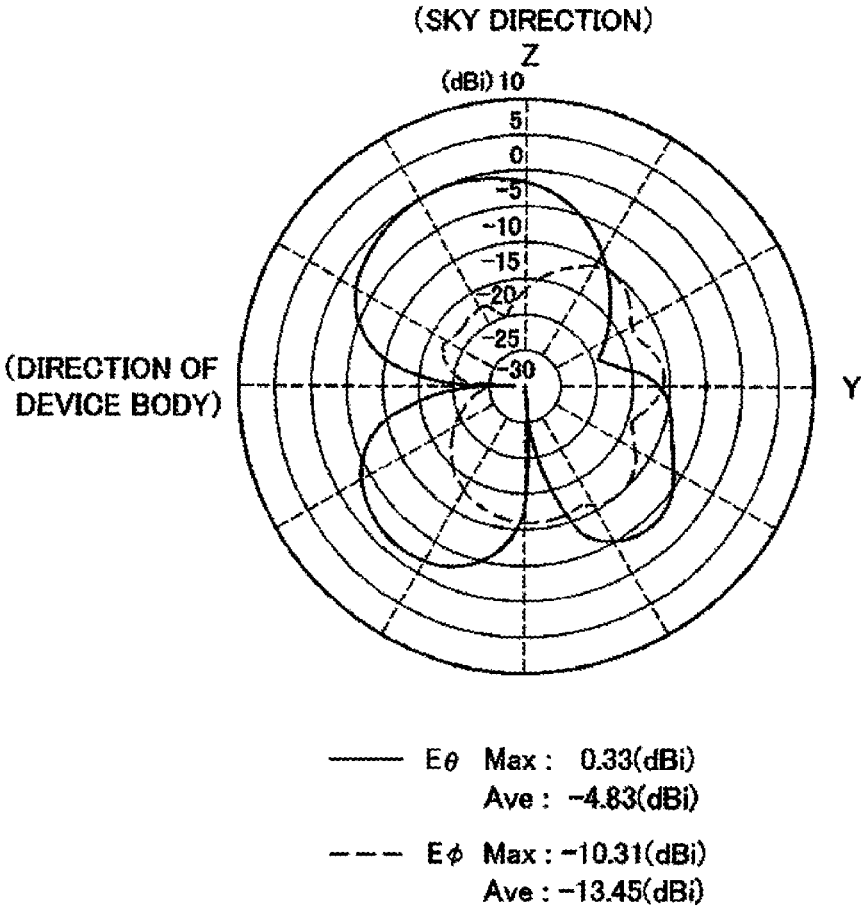
FIG. 15A is a diagram that shows a measurement result of a radiation gain when the antenna according to the second embodiment is mounted on a GPS receiver device.
Figure 15B:
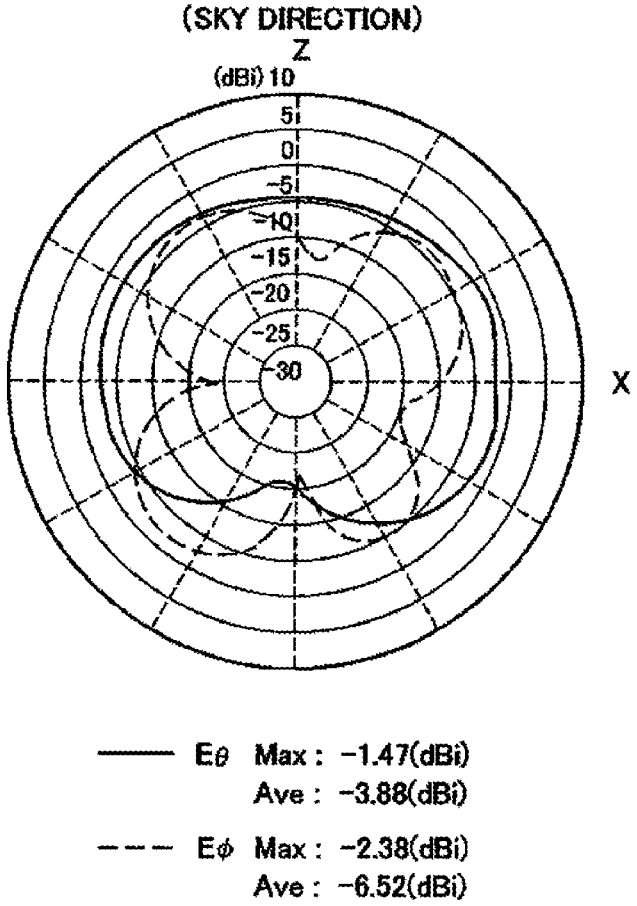
FIG. 15B is a diagram that shows a measurement result of the radiation gain when the antenna according to the second embodiment is mounted on the GPS receiver device.

When the antenna 200 was installed in the GPS receiver, the radiation gain changed due to influence of, for example, the GPS receiver acting as a shielding object. FIG. 15A and FIG. 15B each show the radiation gain in this case. Note that, in order to install the antenna 200 in the GPS receiver, the antenna 200 was arranged such that the coil 41 was laid down and the coil axis was directed in the horizontal direction (the X axis direction). On the other hand, FIG. 16A and FIG. 16B each show a radiation gain of the patch antenna originally installed in the GPS receiver.

Figure 16A:
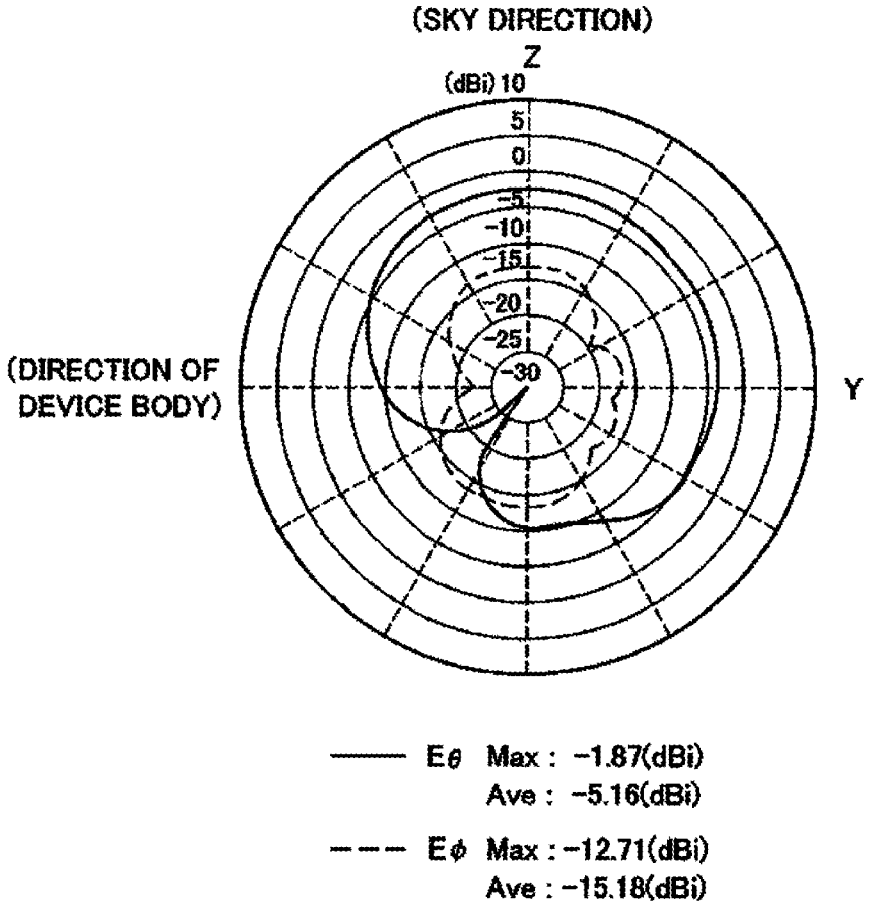
FIG. 16A is a diagram that shows a measurement result of a radiation gain of a patch antenna provided in a GPS receiver according to a related art.
Figure 16B:
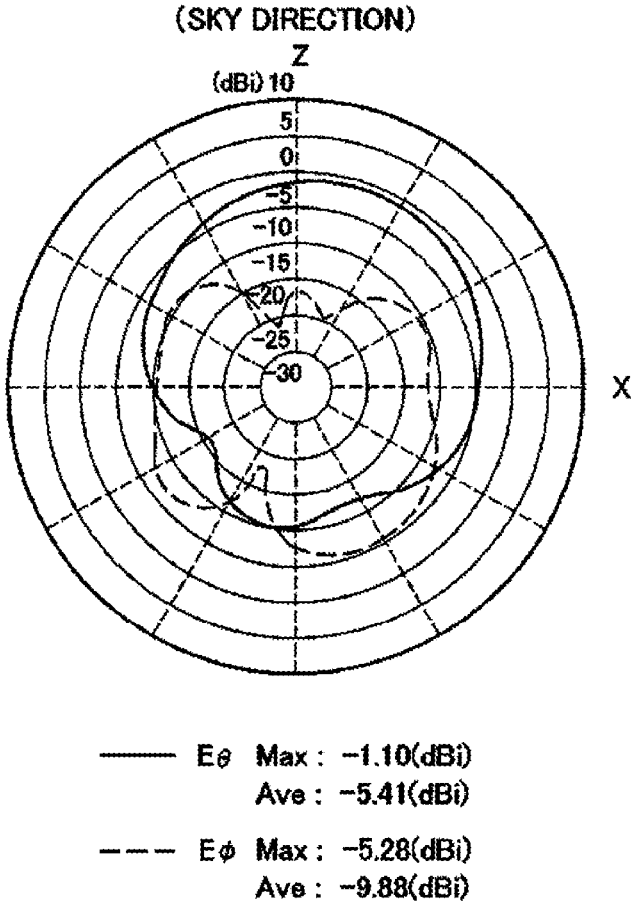
FIG. 16B is a diagram that shows a measurement result of the radiation gain of the patch antenna provided in the GPS receiver according to the related art.

It was found from the comparison of FIG. 15A and FIG. 15B with FIG. 16A and FIG. 16B that the antenna 200 has equivalent performance to the patch antenna in terms of the peak gain and average gain, and the radiation efficiency of the antenna 200 does not deteriorate.

Next, the noise floor of the antenna 200 was measured.

First, a 50Ω terminal, a low noise amplifier (LNA) having a gain of 23.7 dB and a noise figure (NF) of 1.4 dB, and a spectrum analyzer were connected in series without connecting the antenna, and the noise floor of the spectrum analyzer at 1575.4 MHz was measured. As a result, the noise floor was −117 dBm. In this structure, the antenna 200 or the patch antenna was connected instead of the 50Ω terminal, and the noise floor of the spectrum analyzer was measured in the same manner. As a result, the noise floor was −114 dBm in the case of the patch antenna, and −116 dBm in the case of the antenna 200. From this result, it is found that the antenna 200 improved sensitivity to background noise by 2 dB as compared to the patch antenna.

Further, in a state where a GPS receiver body was connected to the antenna 200 or to the patch antenna and a power source of the GPS receiver body was ON, the noise floor of the spectrum analyzer was measured in the same manner. As a result, the noise floor was −109 dBm in the case of the patch antenna, and −115 dBm in the case of the antenna 200. From this result, it is found that the antenna 200 improved sensitivity to background noise including electric noise in the device by 6 dB as compared to the patch antenna.

From the measurements of the noise floor, it was found that the increase in the noise floor of the antenna 200 is smaller than that of the patch antenna. In other words, the antenna 200 is less affected by the influence of electric noise.

Further, quantitative measurement of electric noise is difficult. Therefore, the time required for the positioning of the current position was measured when the antenna 200 was connected to the GPS receiver, and when the patch antenna according to the related art was connected to the same GPS receiver. Thus, performance of receiving signals from the artificial satellite 10 was evaluated. FIG. 17 shows the results.

As can be seen from the measurement results of (5) narrow intersection, (6) under a high tension line, and the like, the antenna 200 can shorten the time required for the positioning of the current position as compared to the patch antenna. In addition, as can be seen from (1) intersection in FIG. 17, the antenna 200 can capture the artificial satellite 10 even in a position where the patch antenna cannot capture the artificial satellite 10.

On the other hand, the radiation gain of the antenna 200 was substantially the same as that of the patch antenna. Therefore, it is also found from the measurement results shown in FIG. 17 that the antenna 200 is less affected by the influence of electric noise as compared to the patch antenna.

It should be understood by those skilled in the art that various modifications, combinations, sub-combinations and alterations may occur depending on design requirements and other factors insofar as they are within the scope of the appended claims or the equivalents thereof.

First Modified Example

Figure 18:
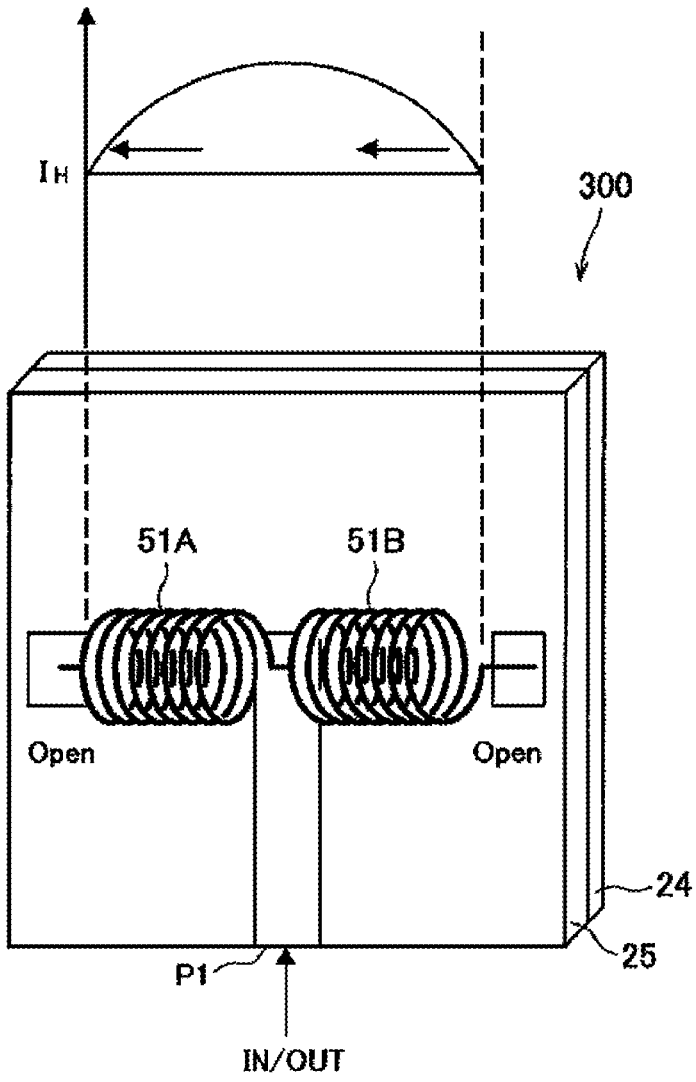
FIG. 18 is an explanatory diagram that illustrates a first modified example of the antenna according to each embodiment of the present invention.

An antenna 300 shown in FIG. 18 can be fabricated, for example, as a magnetic current antenna having an effective wavelength of a half wavelength. The antenna 300 includes two coils 51A and 51B. Each of the coils 51A and 51B has an effective length corresponding to a quarter wavelength with respect to the resonance frequency f0. Each of the coils 51A and 51B is formed using the method described in relation to the coil 23. The coils 51A and 51B are connected such that turning directions thereof are reversed from each other when viewed from a feeding point, and the coil axes are aligned on the same straight line. The feeding point of the antenna 300 is set to the connection point between the coils 51A and 51B. Further, ends of the coils 51A and 51B that are opposite to the feeding point are open to the ground 24.

With the above structure as well, a half wavelength standing wave of the magnetic current $I_H$ can be generated. Accordingly, the coils 51A and 51B can operate as radiation elements having an effective length that is a half wavelength of the magnetic current $I_H$. Here, the coils 51A and 51B are separately formed and connected. However, it is apparent that they may be formed integrally.

Second Modified Example

Figure 19:
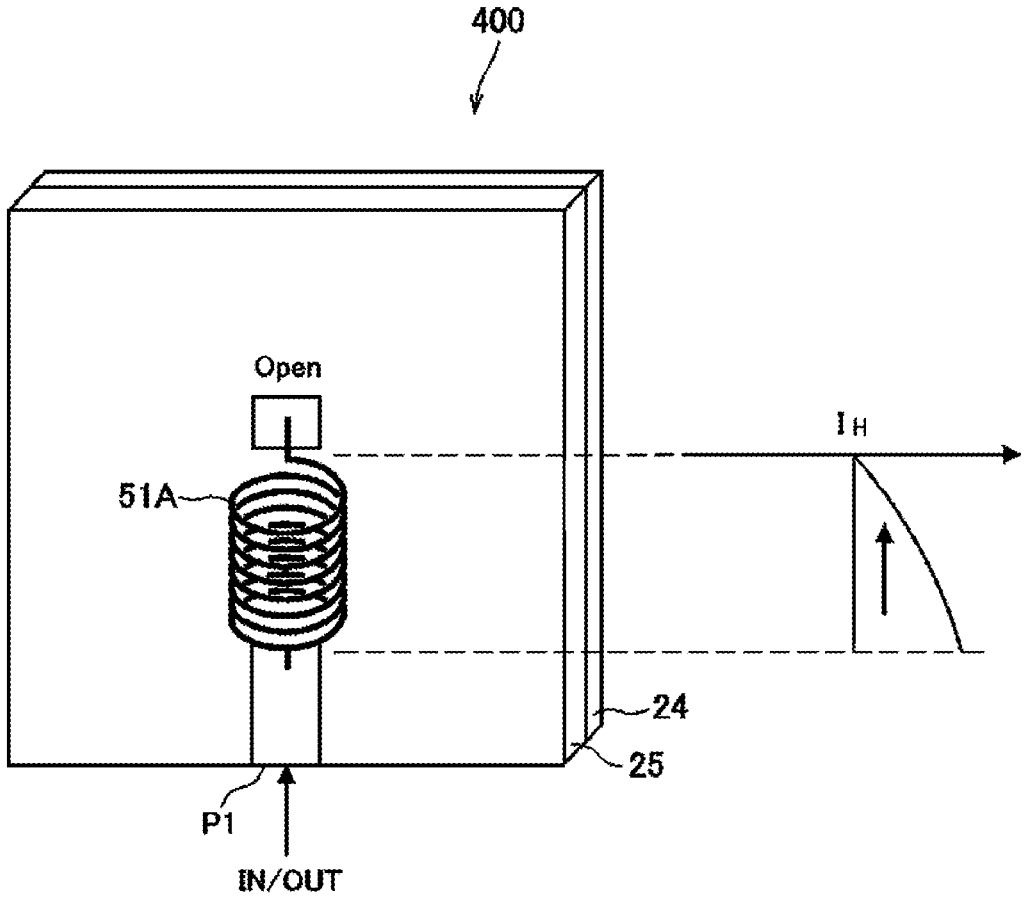
FIG. 19 is an explanatory diagram that illustrates a second modified example of the antenna according to each embodiment of the present invention.

In the above-described embodiments, the antennas 100 and 200 having an effective length corresponding to a half wavelength are described. However, it is also possible to fabricate an antenna 400 having an effective length corresponding to a quarter wavelength as shown in FIG. 19, for example. The antenna 400 includes the coil 51A. The coil 51A has an effective length corresponding to a quarter wavelength with respect to the resonance frequency f0. In this case, because the direction of the magnetic current $I_H$ is constant in the coil 51A, there is no need to reverse the turning direction of the coil.

With the above structure, a quarter wavelength standing wave of the magnetic current $I_H$ can be generated. Accordingly, the coil 51A can operate as a radiation element having an effective length that is a quarter wavelength of the magnetic current $I_H$.

Third Modified Example

Figure 20A:
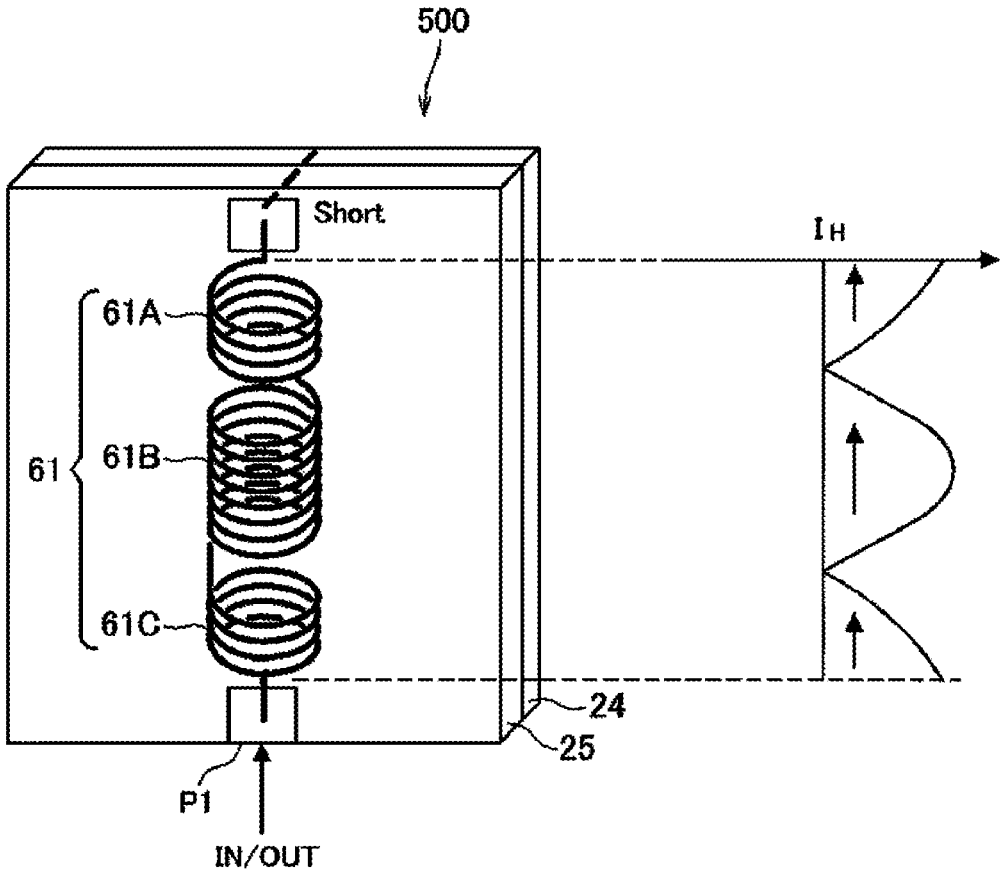
FIG. 20A is an explanatory diagram that illustrates a third modified example of the antenna according to each embodiment of the present invention.

It is also possible to fabricate an antenna 500 having an effective length corresponding to one wavelength as shown in FIG. 20A. The antenna 500 includes a coil 61. The coil 61 is formed to have an effective length corresponding to one wavelength at the resonance frequency f0, using the method described in relation to the coil 23. The coil 61 is divided into 61A to 61C for every turning direction. More specifically, when the coil 61B has one turning direction (for example, clockwise), the other coils 61A and 61C have another turning direction (for example, counterclockwise). In other words, the turning direction of the coil 61 is reversed using nodes of the magnetic current $I_H$ as boundaries. Note that the coil 61 can also be formed such that the coils 61A to 61C are formed separately and connected in series.

With the above structure, a standing wave of one wavelength of the magnetic current $I_H$ can be generated. As a result, the coil 61 can operate as a radiation element having an effective length that is one wavelength of the magnetic current $I_H$. At this time, it is also possible to inhibit mutual cancellation of the magnetic current $I_H$.

Figure 20B:
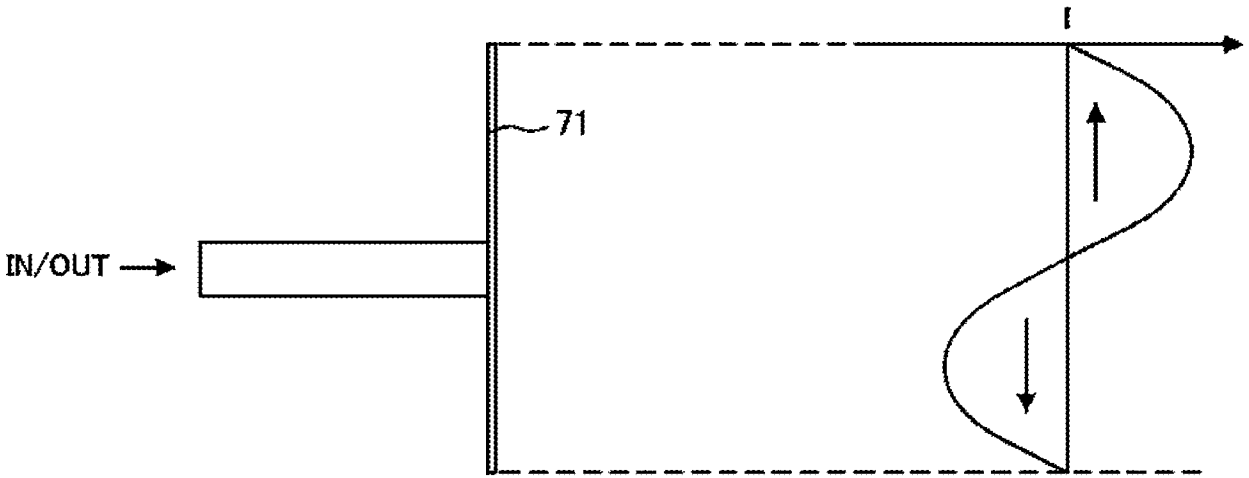
FIG. 20B is an explanatory diagram that illustrates a dipole antenna having an effective length corresponding to one wavelength.

Note that, in the case of a normal current antenna, if a one wavelength radiation element 71 is formed as shown in FIG. 20B and used, mutual cancellation of the current I occurs, and the radiation gain decreases. It is difficult to partially reverse the direction of the current I in order to inhibit the mutual cancellation. The antenna 500 according to the third modified example can inhibit the mutual cancellation of the magnetic current $I_H$, and also can have a longer radiation element, resulting in a further improved radiation gain.

Fourth Modified Example

Figure 21A:
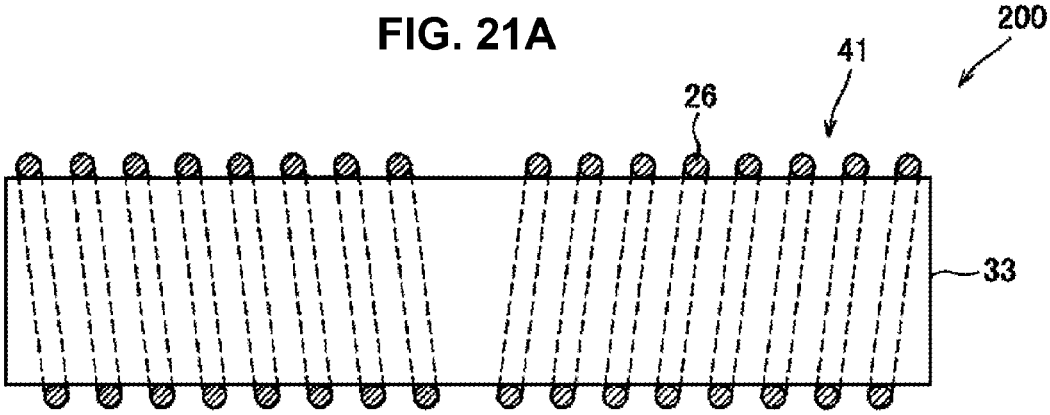
FIG. 21A is an explanatory diagram that illustrates a fourth modified example of the antenna according to each embodiment of the present invention.
Figure 21B:
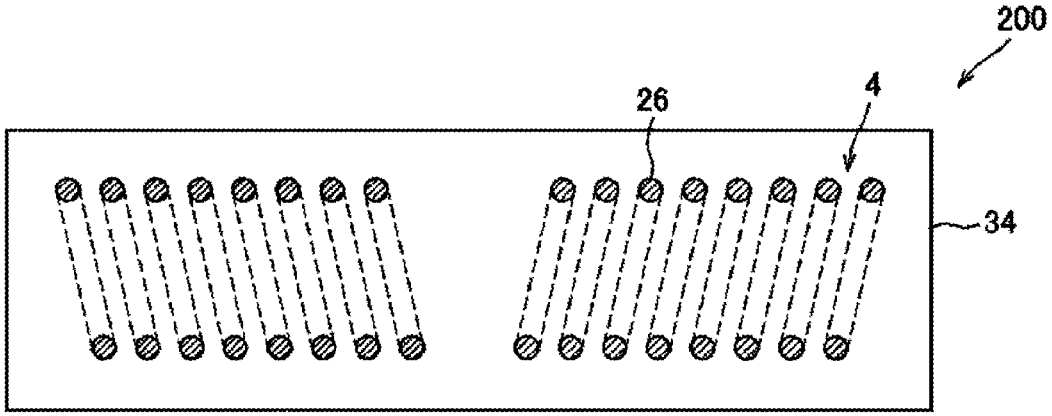
FIG. 21B is an explanatory diagram that illustrates a fourth modified example of the antenna according to each embodiment of the present invention.

In the above-described embodiments, air core coils are used as an example. However, the present invention is not limited to this example. For example, the coil 41 may be formed by winding the winding wire 26 around a core 33 that is formed of a material having a high permeability, as shown in FIG. 21A. Alternatively, the coil 41 may be formed by embedding the winding wire 26 in a core 34 that is formed of a material having a high permeability, as shown in FIG. 21B. The magnitude of the displacement magnetic current $I_H$ generated in the coil 41 is proportional to the permeability of the core. Accordingly, with this structure, the gain of the antenna 200 can further be improved. Although the coil 41 according to the second embodiment is used as an example in FIG. 21A and FIG. 21B, the coil of another embodiment or modified example can be used for antenna fabrication in the same manner.

Further, in the respective embodiments and modified examples described above, the antennas are mainly used for a receiving device (an example of a communication device). However, it will be obviously apparent that these antennas can be used for a transmitting device (an example of a communication device).

Furthermore, in the respective embodiments and modified examples described above, the winding wire 26 is a copper wire. However, the coil may be formed by coating the surface of the winding wire 26 with an insulator. Coating of the winding wire 26 in this manner makes it possible to inhibit a change in resonance frequency due to a short circuit of the radiation element (coil) in the middle.

Moreover, in the respective embodiments and modified examples described above, the coil is placed on the substrate 25 having the bottom surface on which the ground 24 is formed. However, the present invention is not limited to this example. For example, the coil may be placed directly on the ground 24 without interposing the substrate 25.

What is claimed is:

1. An antenna, comprising:

a coil that is formed such that one end of the coil is short circuited or open to a ground and a current standing wave is generated when a high frequency signal is applied to another end of the coil, wherein the coil generates a magnetic field standing wave having a frequency corresponding to the high frequency signal, and thereby detects or radiates an electromagnetic wave having the frequency, and the coil is placed on an upper surface of a substrate having a bottom surface on which a tabular ground is formed, wherein the coil placed on the upper surface of the substrate is opposite from the tabular ground, and wherein the coil has a central axis parallel to the plane formed by a surface of the tabular ground substantially parallel to the bottom surface of the substrate.

2. The antenna according to claim 1, wherein the coil has an effective length that is an integral multiple of a quarter wavelength of the current standing wave.

3. The antenna according to claim 2, wherein a winding wire of the coil is wound in a turning direction so that directions of a magnetic field generated in the coil when the current standing wave is generated are the same.

4. The antenna according to claim 3, wherein the winding wire of the coil is wound in a turning direction that is reversed by setting a node in the magnetic field standing wave as a boundary.

5. The antenna according to claim 4, wherein one end of the coil is short circuited to the ground, the coil has an effective length that is a half wavelength of the current standing wave, and the winding wire of the coil is wound in a turning direction that is reversed by setting a half point of an overall length of the winding wire as a boundary.

6. The antenna according to claim 1, wherein a winding wire of the coil is wound around a surface of a core having a high permeability or embedded in the core.

7. The antenna according to claim 1, wherein a length of the winding wire of the coil is adjusted to a length at which the current standing wave is generated when the high frequency signal is applied.

8. A communication device, comprising:

a coil that is formed such that one end of the coil is short circuited or open to a ground and a current standing wave is generated when a high frequency signal is applied to another end of the coil, wherein the coil generates a magnetic field standing wave having a frequency corresponding to the high frequency signal, and thereby detects or radiates an electromagnetic wave having the frequency, and the coil is placed on an upper surface of a substrate having a bottom surface on which a tabular ground is formed, wherein the coil placed on the upper surface of the substrate is opposite from the tabular ground, and wherein the coil has a central axis parallel to the plane formed by a surface of the tabular ground substantially parallel to the bottom surface of the substrate.

9. The communication device according to claim 8, wherein the coil has an effective length that is an integral multiple of a quarter wavelength of the current standing wave.

10. The communication device according to claim 9, wherein a winding wire of the coil is wound in a turning direction so that directions of a magnetic field generated in the coil when the current standing wave is generated are the same.

11. The communication device according to claim 10, wherein the winding wire of the coil is wound in a turning direction that is reversed by setting a node in the magnetic field standing wave as a boundary.

12. The communication device according to claim 11, wherein one end of the coil is short circuited to the ground, the coil has an effective length that is a half wavelength of the current standing wave, and the winding wire of the coil is wound in a turning direction that is reversed by setting a half point of an overall length of the winding wire as a boundary.

13. The communication device according to claim 8, wherein a winding wire of the coil is wound around a surface of a core having a high permeability or embedded in the core.

14. The communication device according to claim 8, wherein a length of the winding wire of the coil is adjusted to a length at which the current standing wave is generated when the high frequency signal is applied.

15. An antenna manufacturing method, comprising the steps of:

short circuiting or opening one end of a coil serving as a radiation element to a ground;

applying a high frequency signal to another end of the coil;

adjusting a length of a winding wire of the coil so that a current standing wave is generated in the coil by the high frequency signal; and placing the coil on an upper surface of a substrate having a bottom surface on which a tabular ground is formed, wherein the coil placed on the upper surface of the substrate is opposite from the tabular ground, and wherein the coil has a central axis parallel to the plane formed by a surface of the tabular ground substantially parallel to the bottom surface of the substrate.

16. A communication device, comprising:

a coil that is formed such that one end of the coil is short circuited or open to a ground and a current standing wave is generated when a high frequency signal is applied to another end of the coil, wherein the coil generates a magnetic field standing wave having a frequency corresponding to the high frequency signal, and thereby detects or radiates an electromagnetic wave having the frequency, a substrate having a high permeability wherein a tabular ground comprises at least one surface of the substrate, and wherein the coil placed on an upper surface of the substrate that is opposite from the tabular ground, and wherein the coil has a central axis parallel to the plane formed by a surface of the tabular ground substantially parallel to the bottom surface of the substrate.

17. The communication device according to claim 16, wherein the coil has an effective length that is an integral multiple of a quarter wavelength of the current standing wave.

18. The communication device according to claim 17, wherein a winding wire of the coil is wound in a turning direction so that directions of a magnetic field generated in the coil when the current standing wave is generated are the same.

19. The communication device according to claim 18, wherein the winding wire of the coil is wound in a turning direction that is reversed by setting a node in the magnetic field standing wave as a boundary.

20. The communication device according to claim 19, wherein one end of the coil is short circuited to the ground, the coil has an effective length that is a half wavelength of the current standing wave, and the winding wire of the coil is wound in a turning direction that is reversed by setting a half point of an overall length of the winding wire as a boundary.

21. The communication device according to claim 16, wherein a winding wire of the coil is embedded in the substrate or directly contacts the tabular ground.

22. The communication device according to claim 16, wherein a length of the winding wire of the coil is adjusted to a length at which the current standing wave is generated when the high frequency signal is applied.

23. The communication device according to claim 16, wherein a winding wire of the coil is wound around a surface of a core having a high permeability or embedded in the core.

* * * * *